United States Patent [19]

Nakamura

[11] 4,366,233

[45] Dec. 28, 1982

[54] BLIX PROCESS FOR SILVER HALIDE COLOR PHOTOGRAPHIC MATERIALS

[75] Inventor: Kotaro Nakamura, Minami-ashigara, Japan

[73] Assignee: Fuji Photo Film Co., Ltd., Kanagawa, Japan

[21] Appl. No.: 266,768

[22] Filed: May 26, 1981

[30] Foreign Application Priority Data

May 26, 1980 [JP] Japan ..... 55-69971

[51] Int. Cl.[3] ..... G03C 7/00

[52] U.S. Cl. ..... 430/393; 430/505

[58] Field of Search ..... 430/393, 502, 503, 505

[56] References Cited

U.S. PATENT DOCUMENTS

| | | | |
|---|---|---|---|
| 3,695,882 | 10/1972 | Kumai et al. | 430/503 |
| 3,820,997 | 6/1974 | Shirasu et al. | 430/393 |
| 3,822,129 | 7/1974 | Dunn et al. | 430/505 |
| 3,834,907 | 9/1974 | Bissonette | 430/505 |
| 3,904,413 | 9/1975 | Mowrey | 430/505 |
| 4,219,615 | 8/1980 | Sakai | 430/503 |

*Primary Examiner*—J. Travis Brown

*Attorney, Agent, or Firm*—Sughrue, Mion, Zinn, Mcpeak & Seas

[57] ABSTRACT

The reduction in cyan coloring density of a color photographic paper caused by the conversion of cyan dye into leuco compound during blixing is prevented by reducing the total amount of silver contained in the silver halide emulsion layer or layers disposed between the cyan coloring silver halide emulsion layer and the support of the color photographic paper. The total amounts of silver in these layers should be 0.6 g/m$^2$ or less. When the silver content is reduced in order to prevent a reduction in cyan color density, it is generally desirable to utilize only particular magenta couplers in order to avoid reducing the magenta color density.

3 Claims, No Drawings

BLIX PROCESS FOR SILVER HALIDE COLOR PHOTOGRAPHIC MATERIALS

FIELD OF THE INVENTION

This invention relates to a blix process for silver halide color photographic materials and, more particularly, to a blix process for silver halide color photographic materials, which can prevent inferior coloring by the leuco compounds of cyan dyes occurring during blix processing. The invention further relates to silver halide color photographic materials which do not cause inferior coloring by the leuco compounds of cyan dyes during blix processing.

BACKGROUND OF THE INVENTION

In order to form color images, a silver halide color printing material is usually subjected to a series of processing steps after light exposure. In more detail, a light-exposed silver halide color photographic printing material is subjected to a color development step, thereby a color developing agent reduces light-exposed silver halide to form developed silver. At the same time the color developing agent itself is oxidized to form an oxidation product of the color developing agent, which reacts with couplers to form colored dyes. Then, in the subsequent silver removing step, the developed silver is oxidized by an oxidizing agent (ordinarily, called a bleaching agent) and further removed by fixing together the silver halide remaining without effecting the color developing reaction. Accordingly, dye images corresponding to the light exposure are formed. Furthermore, if desired, a stabilization bath for stabilizing dye images is employed.

Within the silver removing step, it is possible to utilize two separate baths. One bath is a bleach bath containing an inorganic oxidizing agent such as a potassium ferricyanide, a dichromate, etc., or an organic chelating compound such as an aminopolycarboxylic acid metal complex salt, etc. Another bath is a fix bath containing a silver halide solubilizing agent such as a thiosulfate, etc. Furthermore, it is possible to utilize both of these baths in one bath as a blix bath. If an inorganic bleaching agent is used in the blix solution, it is difficult to use a silver halide solubilizing agent in the same processing solution due to the very strong oxidizing power of the inorganic bleaching agent. Accordingly, an organic chelating compound such as an aminopolycarboxylic acid metal complex salt, etc., is generally used as the bleaching agent.

Formation of colored dyes is composed of two steps. That is, the oxidation product of a developing agent formed in a color development step reacts with a coupler to form a colorless leuco compound which is an intermediate of the coupler. The leuco compound is further oxidized with the oxidation product to form a colored dye. The formation of the colored dye from the leuco compound by only a color development step is generally insufficient. The leuco compound is further oxidized with a bleaching agent in a bleach bath or a blix bath to form a complete colored dye. Therefore, when the bleaching agent in a bleach bath or a blix bath does not exhibit a sufficient oxidizing power due to factors such as the fatigue of the bath, etc., the leuco compound remains partially unreacted and does not form a colored dye. This causes insufficient color reproduction even when using an inorganic bleaching agent such as a potassium ferricyanide, a dichromate, etc., for the bleach bath. In particular, the oxidizing power of a bleaching agent in a blix bath is known to be relatively weak. Accordingly, when the blix processing is performed directly after the step using a processing solution containing a reducing agent (e.g., the step using a color developer), the leuco compound does not form a colored dye by the action of the reducing agent carried in the blix solution by photographic materials. Furthermore, the colored dye once formed is reduced and converted into the leuco compound by the action of the reducing agent carried in the blix solution by photographic materials. Accordingly, the coloring density is decreased and sufficient color reproduction is not obtained. A cyan dye is particularly likely to be converted into the leuco compound and thus the coloring density thereof is greatly decreased. Therefore, when utilizing a blix solution in which a strong bleaching agent cannot be used, the conversion of the cyan dye into the leuco compound is a big trouble.

The above-described trouble can be overcome if one of the following three methods can be carried out. The first method is the most direct one, and involves using an oxidizing bath containing a potassium ferricyanide, dichromate, etc., having sufficient oxidizing power. This bath is used separately from the blix bath. However, due to the pollution problem created by he waste solution and the demand for faster processing steps, this method is not practical. The second method involves using a cyan coupler capable of forming a dye which is reluctant to convert into the leuco compound by reduction during blix processing. However, in spite of various investigations over a long period of time, cyan couplers having sufficiently desirable properties have not been discovered. The third method involves reducing the load on the bleaching agent in a blix bath. The bleaching agent in a blix bath is involved in oxidizing leuco compounds into colored dyes as well as in dissolving off silver in photographic materials from the system with a silver halide solubilizing agent. Accordingly, if too much of the bleaching agent strength is applied to the silver removing reaction, the oxidizing power of the bleaching agent for oxidizing the leuco compounds will be lost. This results in decreasing the coloring density of cyan dyes. With this problem in mind, there has been proposed a method wherein a compound such as a halogen ion, ethylene oxide, or a mercapto compound, is added to the blix bath to promote the silver removing reaction. This prevents the conversion of the cyan dyes into the leuco compounds. However, even by using this method, insufficient results are attained.

SUMMARY OF THE INVENTION

Therefore, an object of this invention is to prevent the conversion of cyan dyes into leuco compounds in a blix processing step by a blix solution contaminated with a reducing agent such as a developing agent.

A silver halide color photographic printing material is usually composed of a support having coated thereon three kinds of silver halide emulsion layers. Each layer is selectively sensitized to possess sensitivity for blue light, green light and red light, respectively. In general, red-, green- and blue-sensitive silver halide emulsion layers are coated on a support in this order from the side to be light-exposed. In addition to these silver halide emulsion layers, an ultraviolet absorption layer, a color mixing preventing layer, and a protective layer, and other layer may be coated for specific purposes. These silver halide emulsion layers may be disposed in orders other than the aforesaid order. Furthermore, two kinds of silver halide emulsion layers may be used for each color light with each layer having sensitivity for substantially the same wavelength region. The blue-sensitive emulsion layer, green-sensitive emulsion layer and red-sensitive emulsion layer contain a yellow coupler for forming yellow dye images, a magenta coupler for forming magenta dye images, and cyan coupler for forming cyan dye images, respectively.

The present inventors have carried out various investigations on the general layer dispositions of silver halide color photographic printing materials as described above. As a result of these investigations, the inventors have made the very interesting discovery. They have found that when performing blix processing, there is a clear interrelation between the conversion of cyan dyes into leuco compounds and the total silver amount in the silver halide emulsion layers disposed under the silver halide emulsion layer containing cyan coupler. In more detail, it has been found that when a silver halide color photographic material having a cyan coloring silver halide emulsion layer at the farthest position from the support is processed with a blix solution containing an organic chelating compound as the bleaching agent along with a small amount of a reducing agent such as a color developing agent, the conversion of cyan dyes into leuco compounds becomes remarkably high when the total amount of silver contained in the silver halide emulsion layers disposed under the cyan coloring emulsion layer is larger than 0.6 g/m$^2$.

Therefore, the object of this invention described above can be attained by reducing the total amount of silver in the silver halide emulsion layers disposed between the cyan coloring silver halide emulsion layer and the support of a silver halide color photographic printing material.

DETAILED DESCRIPTION OF THE INVENTION

The improved results obtained by using this invention are particularly remarkable when using a blix solution containing a bleaching agent in an amount of 0.01 to 1 mol, more preferably 0.05 to 0.5 mol, per liter of the blix solution and a color developing agent (as a contaminant) in an amount of $10^{-4}$ to 1 mol, more preferably $10^{-3}$ to $10^{-1}$ mol, per mol of the bleaching agent.

This invention is based on the unexpected fact that the tendency of converting cyan dyes into leuco compounds is influenced by the amount of silver contained in the silver halide emulsion layers disposed between the cyan coloring silver halide emulsion layer containing the cyan dyes and the support rather than by the amount of silver in the cyan coloring emulsion layer itself.

The invention is also based on discovering that the tendency to convert cyan dyes into leuco compounds is great when the amount of silver (in the silver halide emulsion layers disposed at the positions nearer to the support than the cyan coloring silver halide emulsion layer) is greater than 0.6 g/m$^2$. The tendency to convert into leuco compounds is much less when the silver amount is smaller than 0.6 g/m$^2$.

Preferred bleaching agents used in connection with this invention include; an organic complex salt of iron (III) or cobalt (III), e.g., the complex salt of an aminopolycarboxylic acid such as ethylenediamine tetraacetic acid, nitrolotriacetic acid, 1,3-diamino-2-propanol tetraacetic acid, or an organic acid such as citric acid, tartaric acid, malic acid. Among these compounds, sodium iron (III) ethylenediamine tetraacetic acid and ammonium iron (III) ethylenediamine tetraacetic acid are particularly useful.

The color developing agents used in connection with this invention include: known primary aromatic amine developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline).

Other color developing agents described in L. F. A. Mason, *Photographic Processing Chemistry*, pages 226–229 (published 1966 by Focal Press); U.S. Pat. Nos. 2,193,015 and 2,592,364 and Japanese Patent Application (OPI) No. 64933/73 (the term "OPI" as used herein refers to a "published unexamined Japanese patent application") are useful color developing agents.

Cyan couplers used in connection with this invention include known phenolic cyan couplers and naphtholic cyan couplers. The phenolic cyan couplers shown by general formula (I) are particularly preferred:

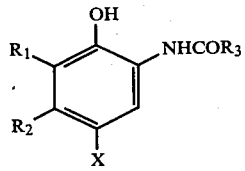

(I)

wherein $R_1$ and $R_2$ are each independently hydrogen, a halogen atom, an alkyl group, a substituted alkyl group, an aryl group, a substituted aryl group, an amino group, a carbamoyl group, or an acylamino group; $R_3$ represents an alkyl group, a substituted alkyl group, an aryl group, or a substituted aryl group; and X represents hydrogen or a coupling-off group.

Typical examples of the cyan couplers used in connection with this invention are illustrated below, although the invention is not limited to these couplers.

(C-1)

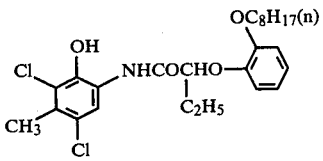

(C-2)

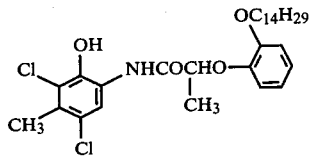

-continued
(C-3)
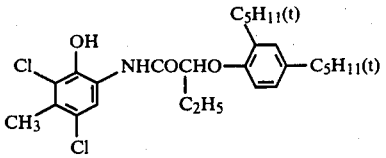
(C-4)
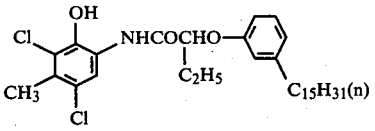
(C-5)
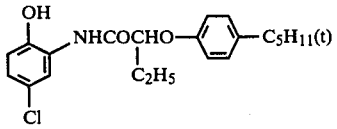
(C-6)
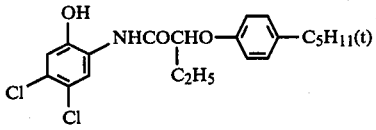
(C-7)
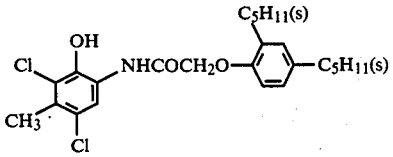
(C-8)
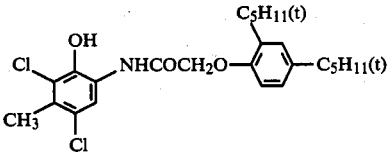
(C-9)
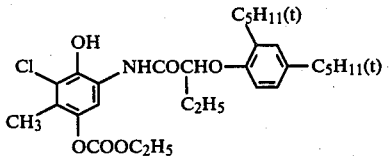
(C-10)
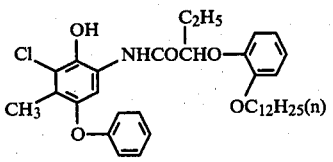
(C-11)
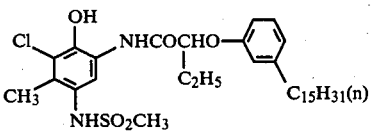
(C-12)
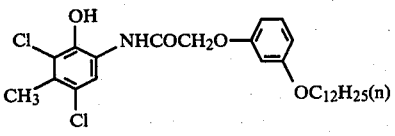
(C-13)
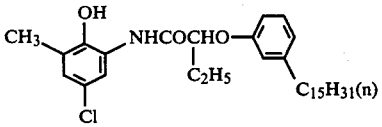
(C-14)
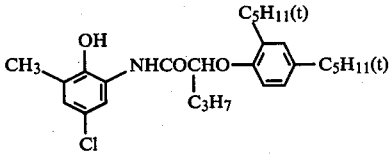
(C-15)
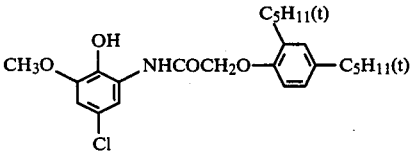
(C-16)
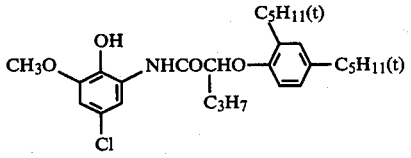
(C-17)
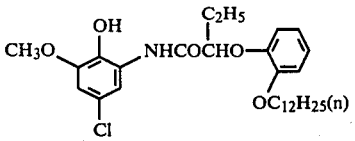
(C-18)
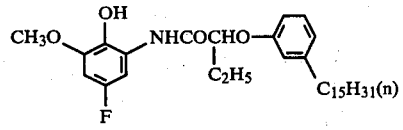
(C-19)
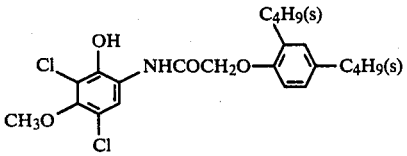
(C-20)
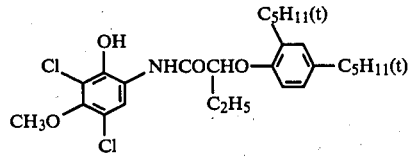
(C-21)
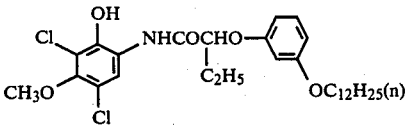
(C-22)
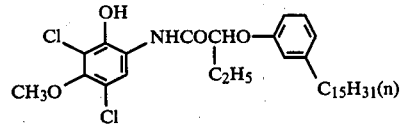

-continued
(C-23)
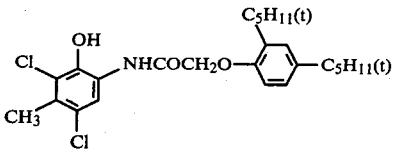
(C-24)
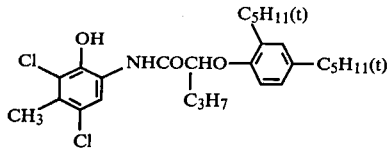
(C-25)
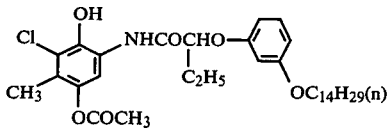
(C-26)
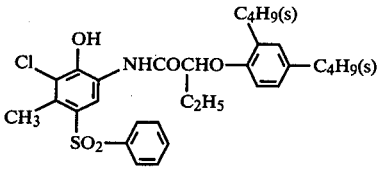
(C-27)
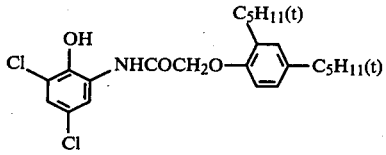
(C-28)
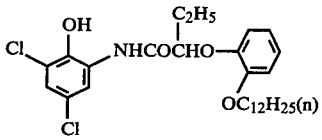
(C-29)
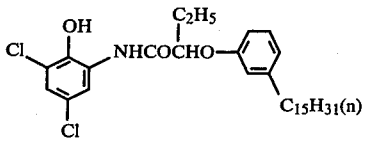
(C-30)
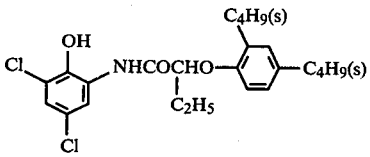
(C-31)
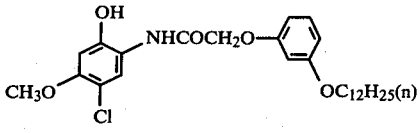
(C-32)
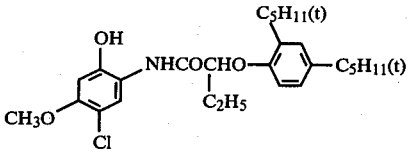
(C-33)
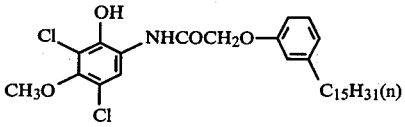
(C-34)
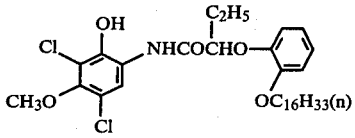
(C-35)
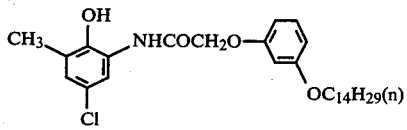
(C-36)
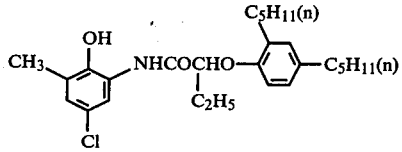
(C-37)
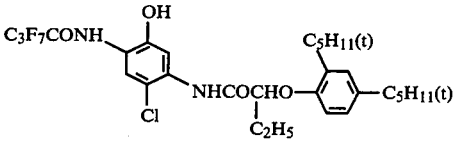
(C-38)
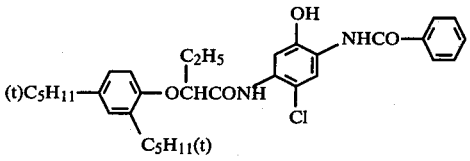
(C-39)
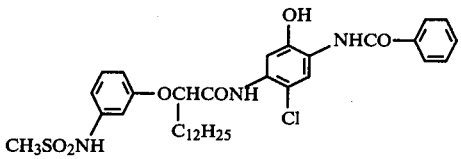
(C-40)
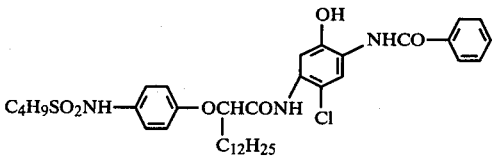
(C-41)
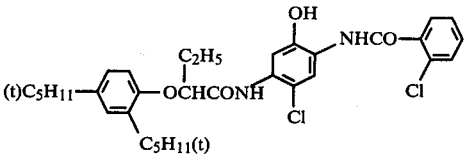
(C-42)
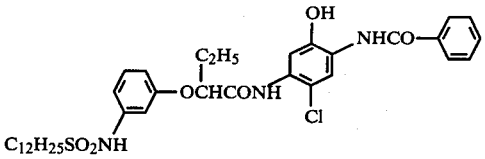

-continued (C-43)

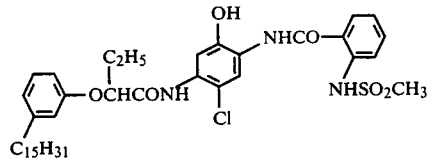

(C-44)

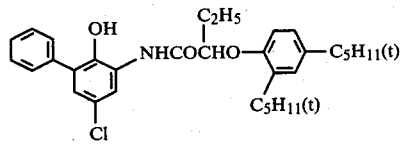

(C-45)

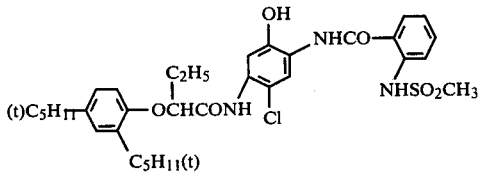

Particularly preferred cyan couplers are couplers (C-3), (C-8), (C-40), (C-43) and (C-45).

Yellow couplers and magenta couplers used in connection with this invention include any of those known. However, yellow couplers shown by following general formula (II) and the magenta couplers shown by general formula (III) are preferred, and further 2-equivalent couplers are more preferred.

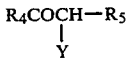

(II)

wherein $R_4$ represents an alkyl group, a substituted alkyl group, an aryl group, or a substituted aryl group; $R_5$ represents a cyano group or an N-phenylcarbamoyl group which may have a substituent; and Y represents a coupling-off group.

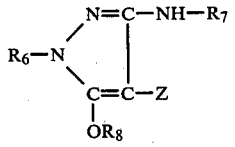

(III)

wherein $R_6$ and $R_7$ each represents a phenyl group which may have a substituent; $R_8$ represents an acyl group or hydrogen atom; and Z represents hydrogen atom or a coupling-off group.

Now, typical examples of the yellow couplers used in this invention are illustrated below, although the invention is not limited to them.

(Y-1)

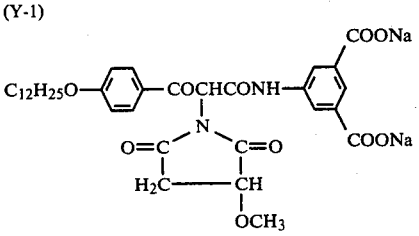

(Y-2)

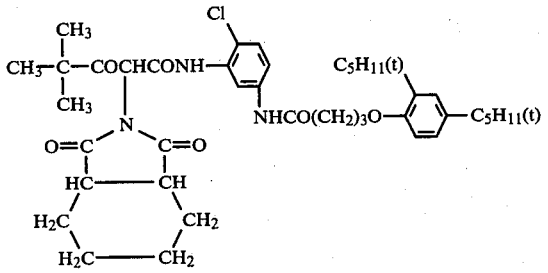

(Y-3)

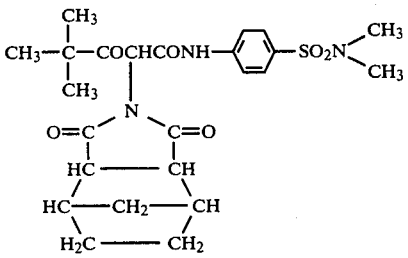

(Y-4)

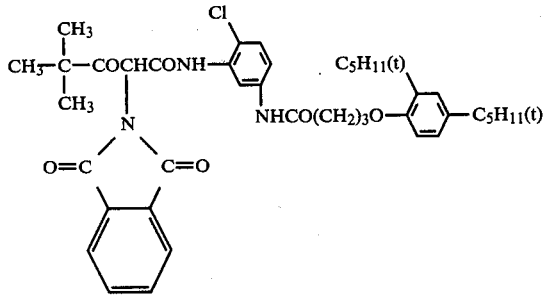

(Y-5)

-continued
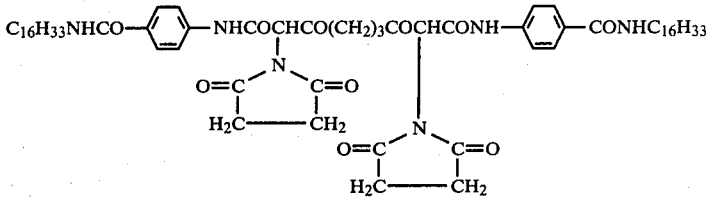
(Y-6)
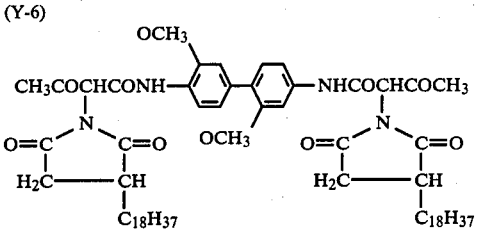
(Y-7)
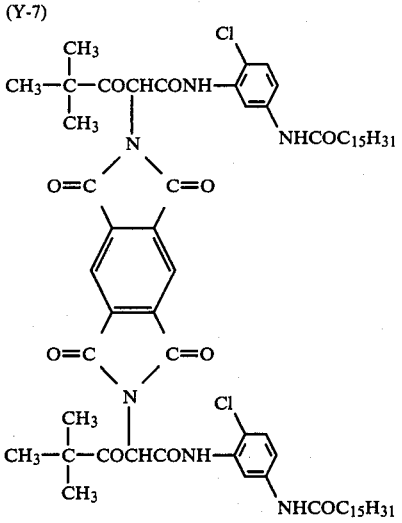
(Y-8)
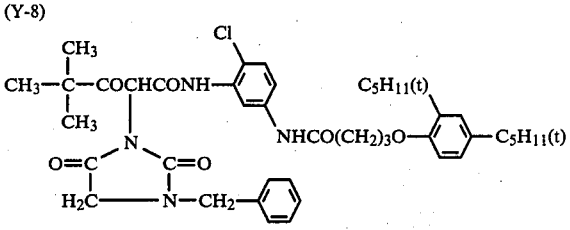
(Y-9)
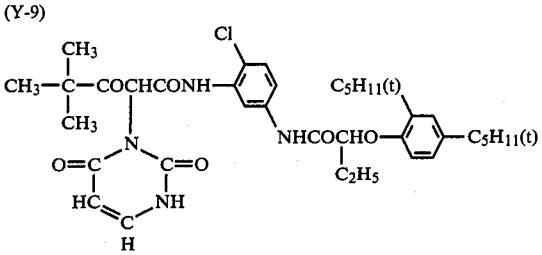
(Y-10)
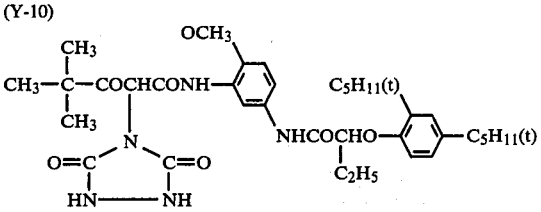
(Y-11)
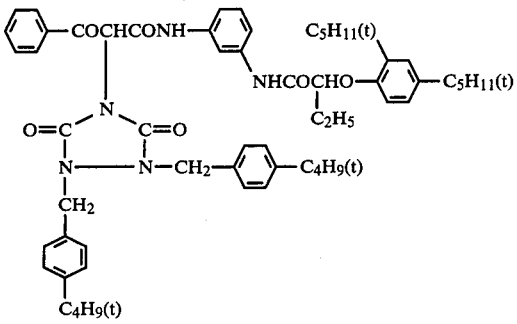
(Y-12)
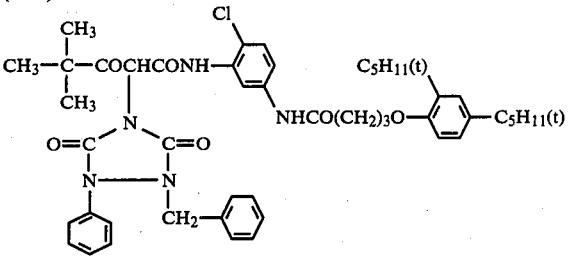
(Y-13)
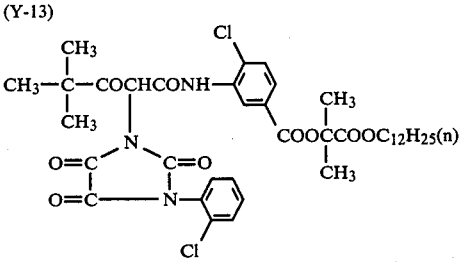
(Y-14)
(Y-15)

-continued
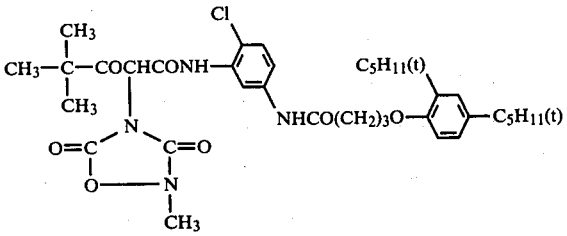
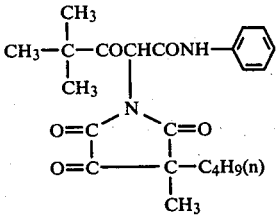
(Y-16)
(Y-17)
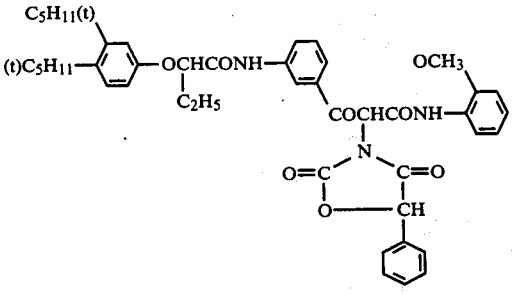
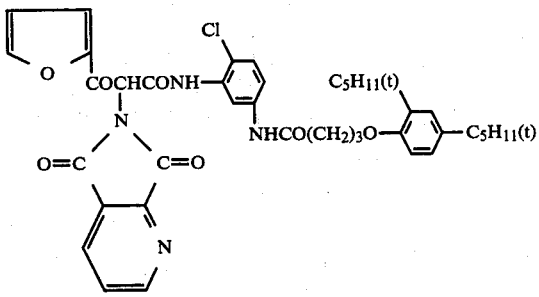
(Y-18)
(Y-19)
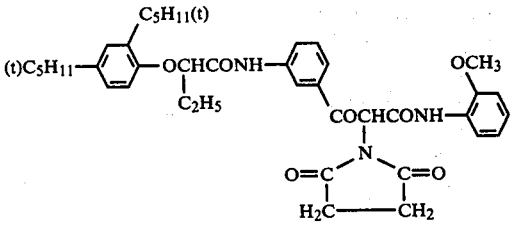
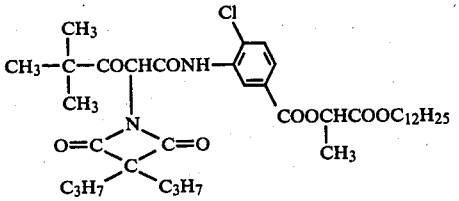
(Y-20)
(Y-21)
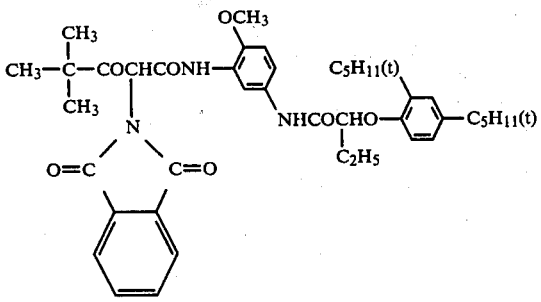
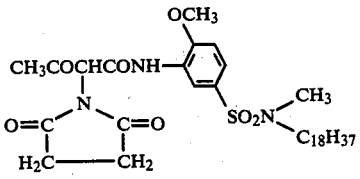
(Y-22)
(Y-23)
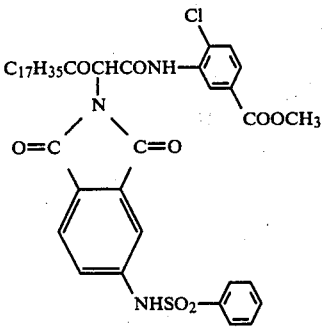
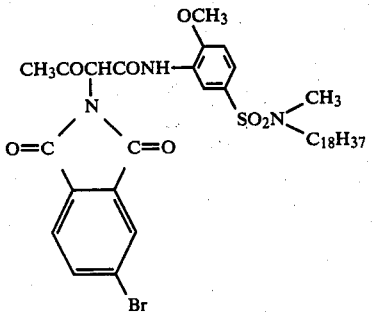
(Y-24)
(Y-25)

-continued
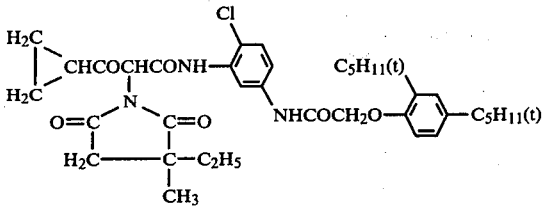
(Y-26)
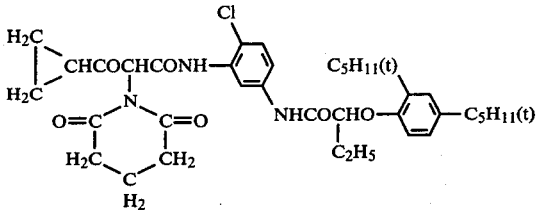
(Y-27)
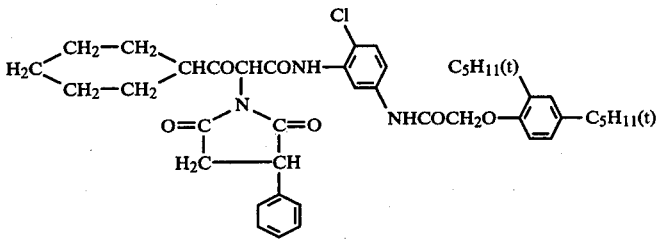
(Y-28)
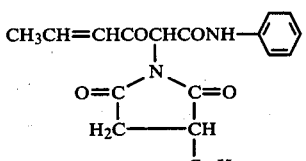
(Y-29)
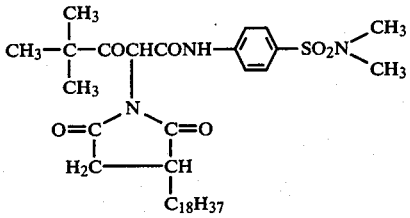
(Y-30)
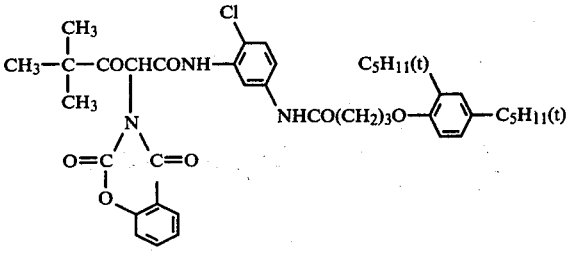
(Y-31)
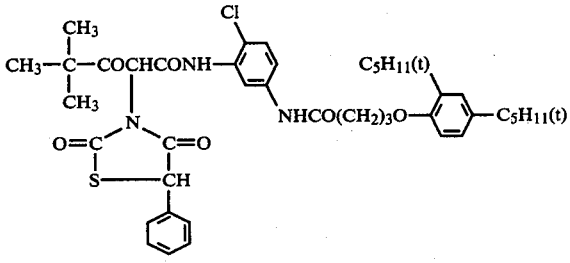
(Y-32)
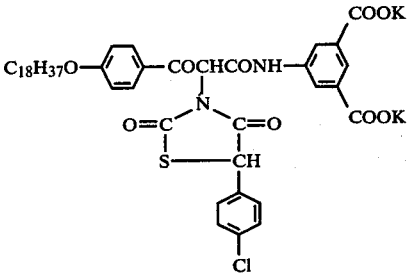
(Y-33)
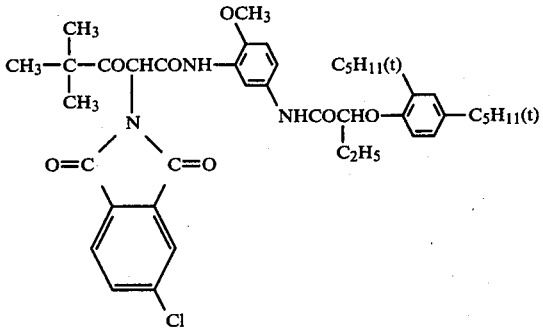
(Y-34)
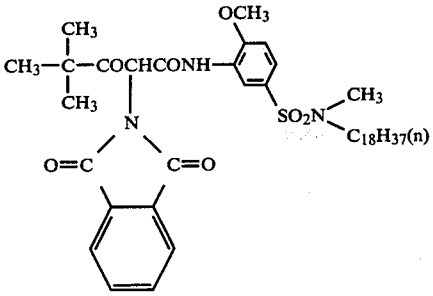
(Y-35)

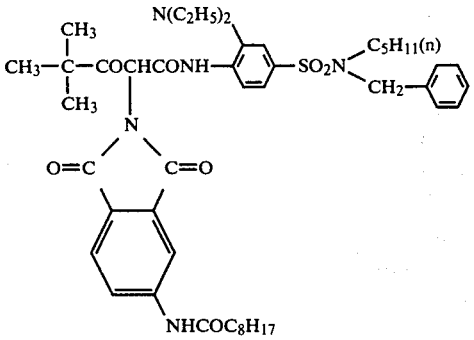
-continued
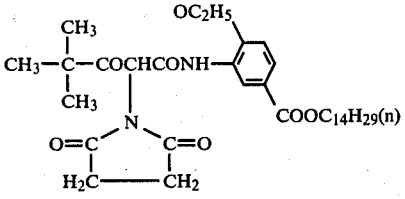
(Y-36)
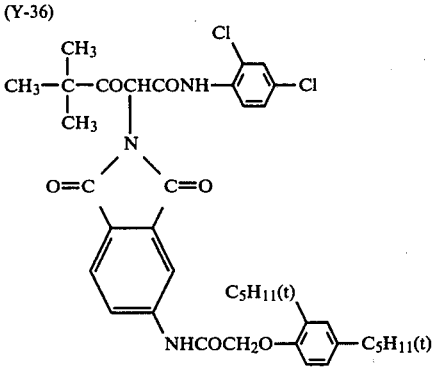
(Y-37)
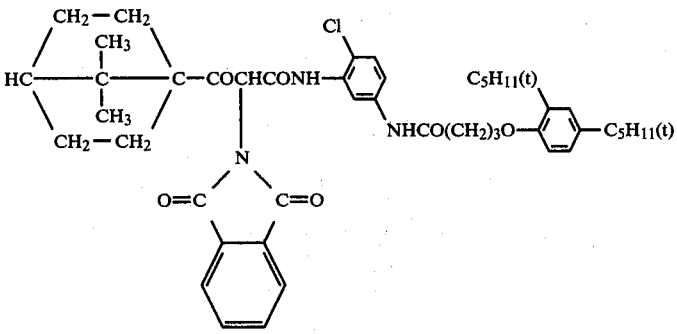
(Y-38)
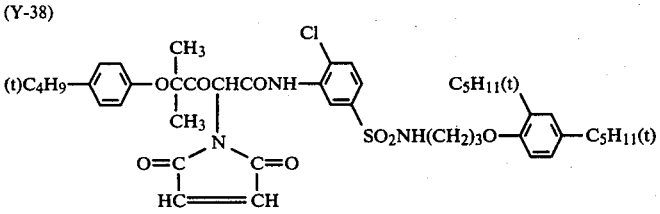
(Y-39)
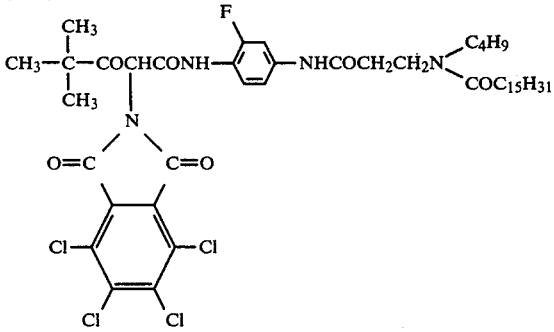
(Y-40)
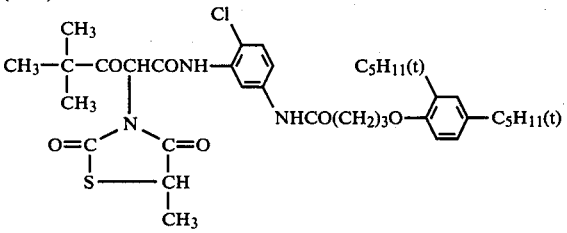
(Y-41)
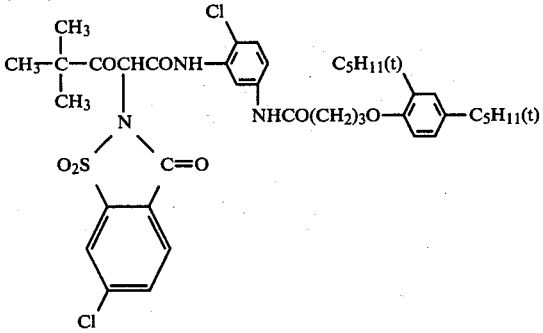
(Y-42)
(Y-43)

-continued
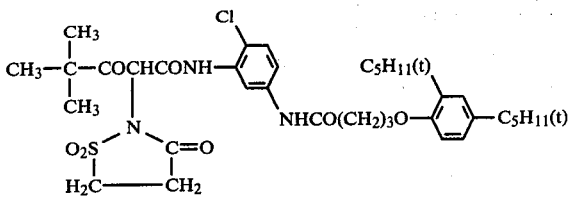
(Y-44)
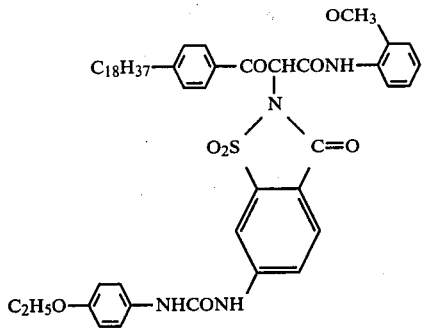
(Y-45)
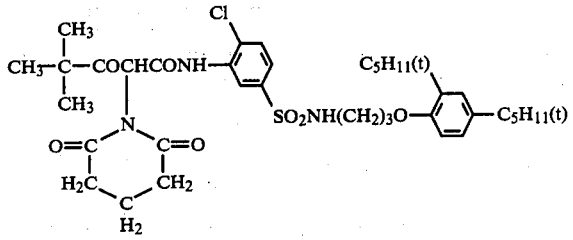
(Y-46)
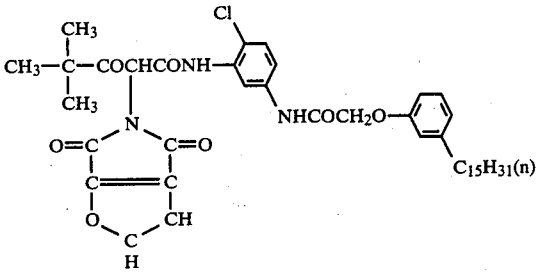
(Y-47)
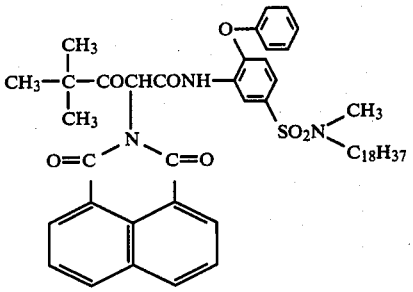
(Y-48)
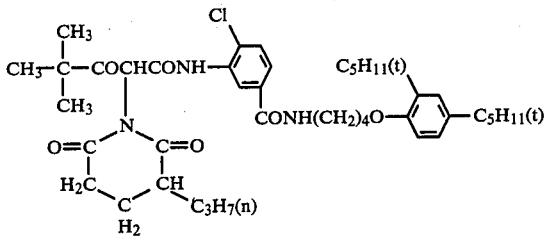
(Y-49)
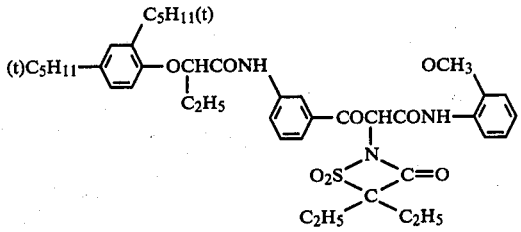
(Y-50)
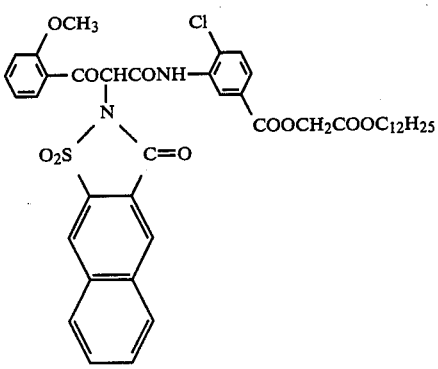
(Y-51)

-continued
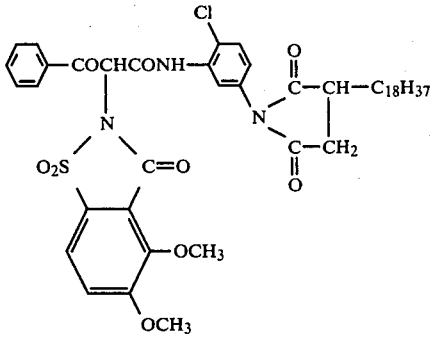
(Y-52)
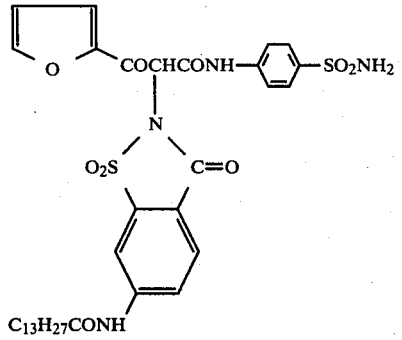
(Y-53)
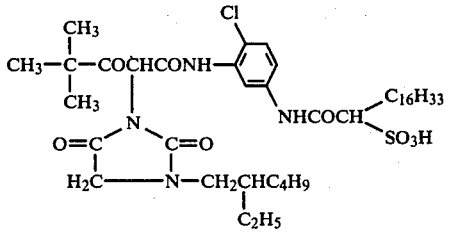
(Y-54)
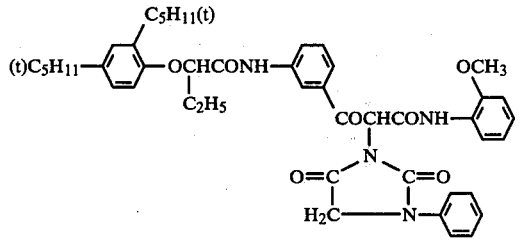
(Y-55)
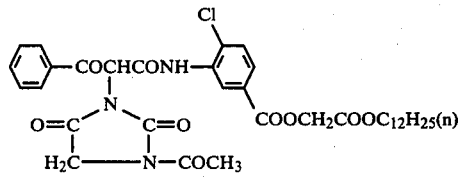
(Y-56)
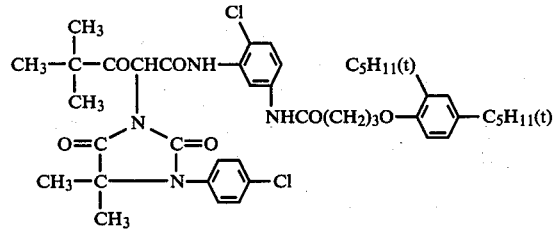
(Y-57)
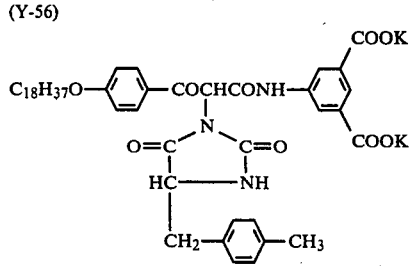
(Y-58)
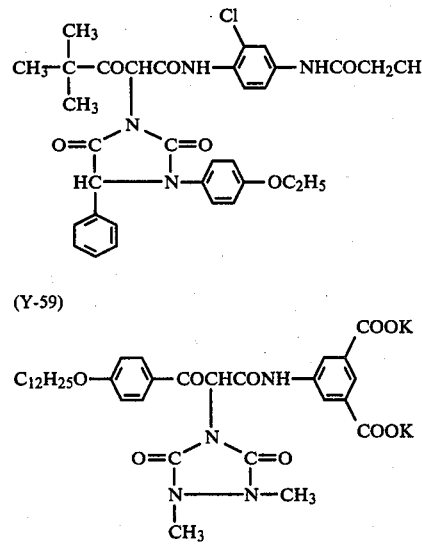
(Y-59)
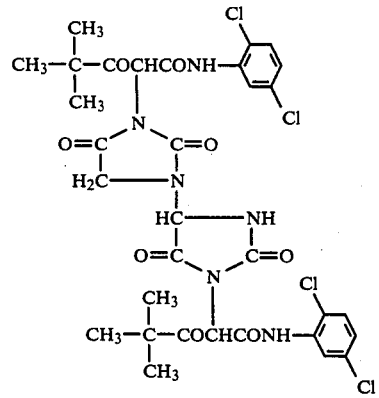
(Y-60)
(Y-61)

-continued
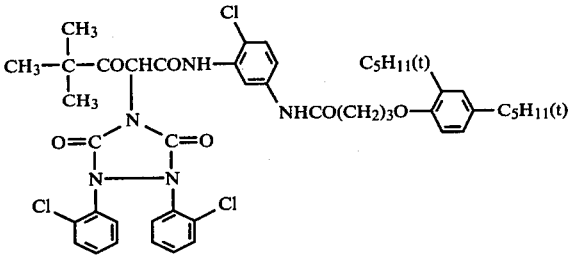
(Y-62)
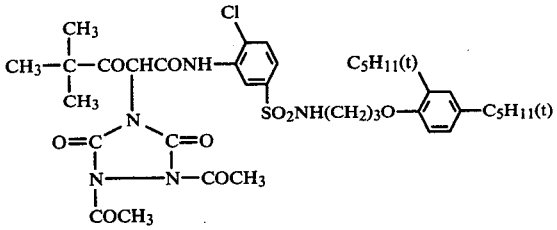
(Y-63)
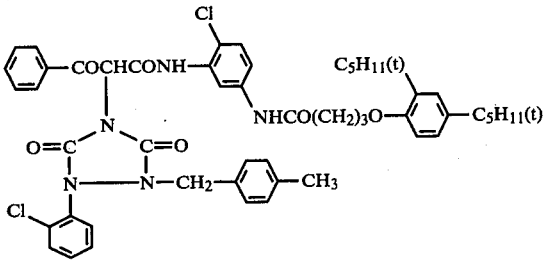
(Y-64)
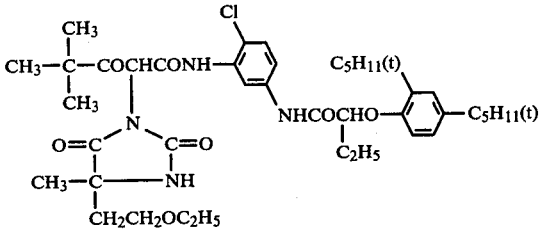
(Y-65)
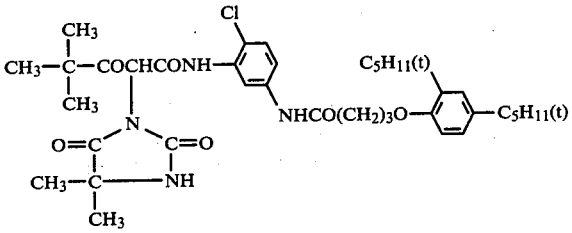
(Y-66)
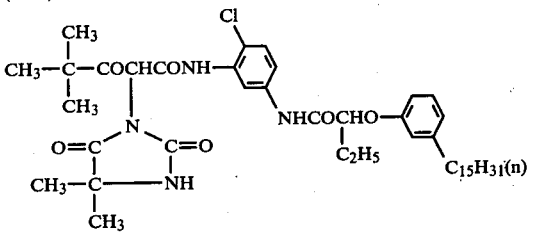
(Y-67)
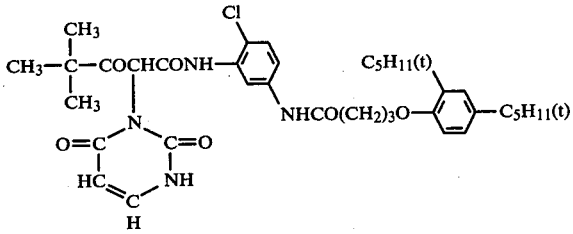
(Y-68)
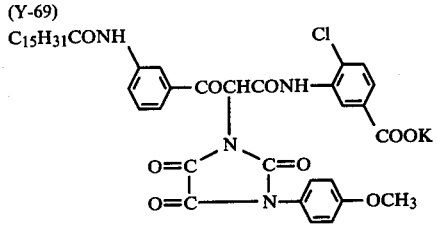
(Y-69)
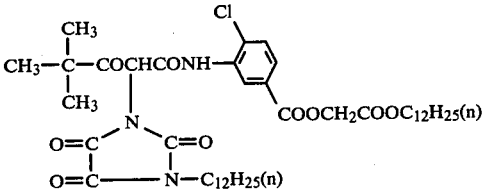
(Y-70)
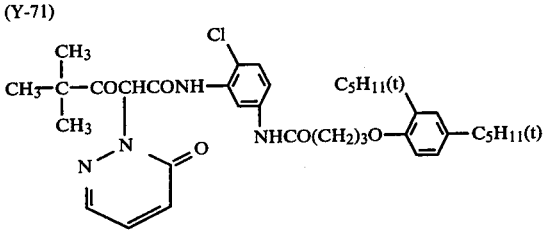
(Y-71)
(Y-72)
(Y-73)

-continued
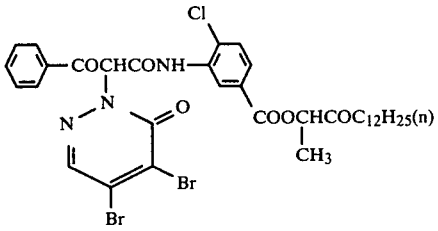
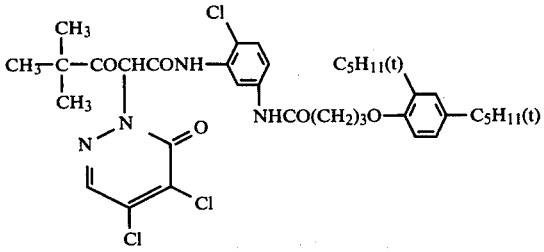
(Y-74)
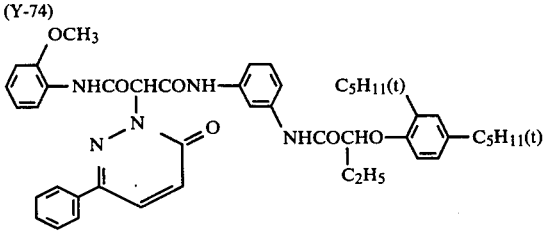
(Y-75)
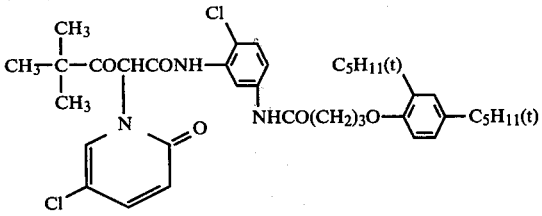
(Y-76)
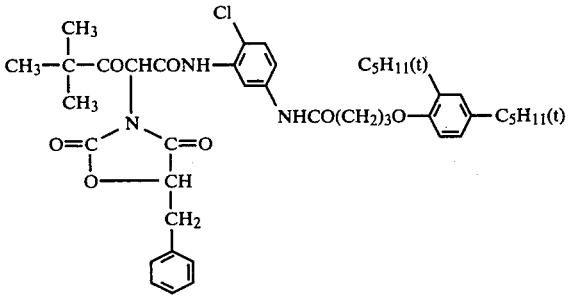
(Y-77)
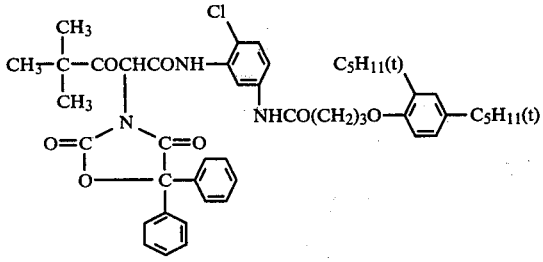
(Y-78)
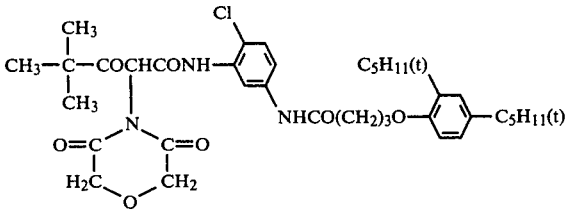
(Y-79)
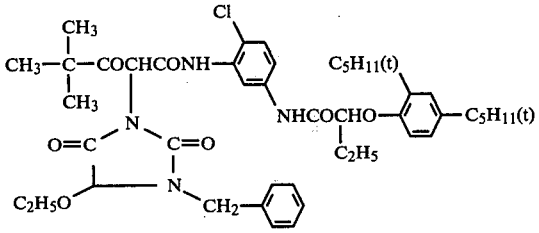
(Y-80)
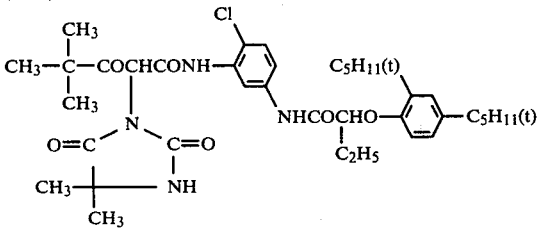
(Y-81)
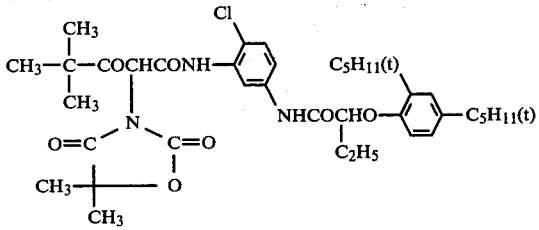
(Y-82)
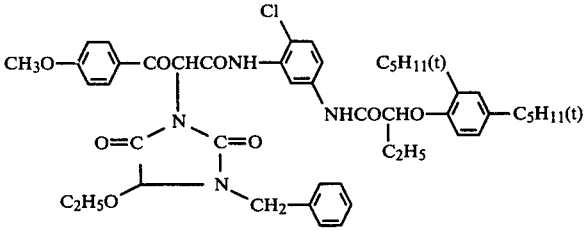
(Y-83)
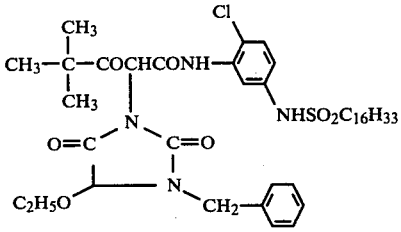
(Y-84)

-continued
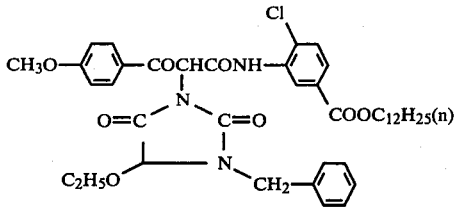
Particularly preferred yellow couplers are couplers (Y-8), (Y-64), (Y-79), (Y-80) and (Y-81).
Typical examples of magenta couplers used in this invention are illustrated below although the invention is not limited to them.
(M-1)
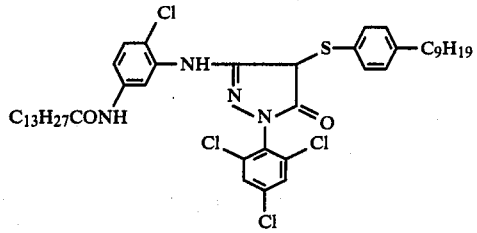
(M-2)
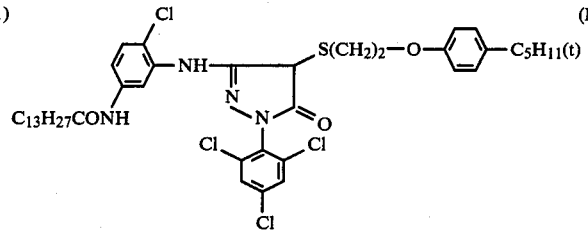
(M-3)
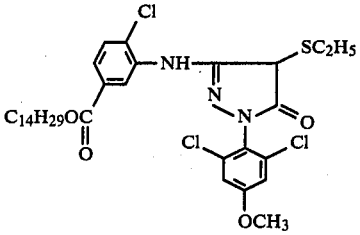
(M-4)
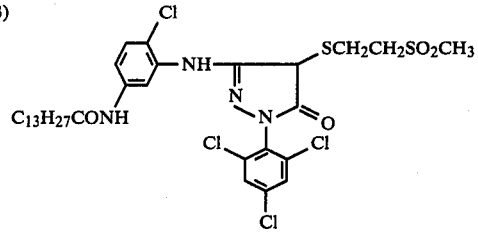
(M-5)
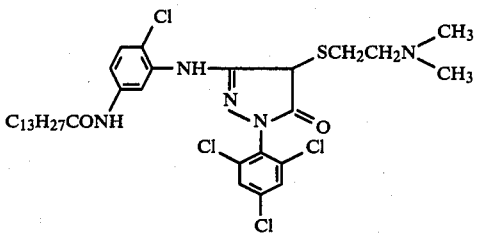
(M-6)
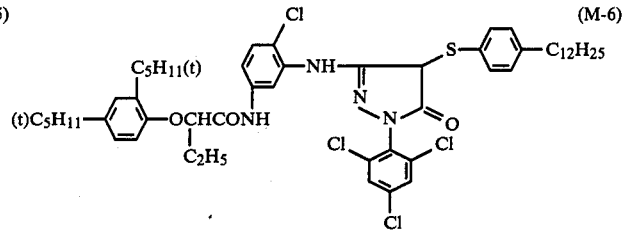
(M-7)
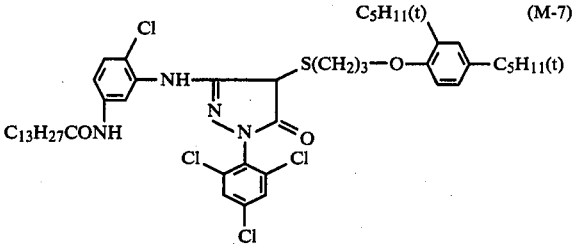
(M-8)
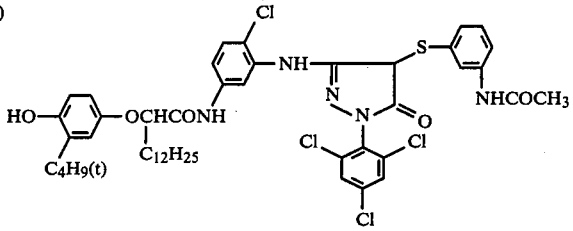
(M-9)
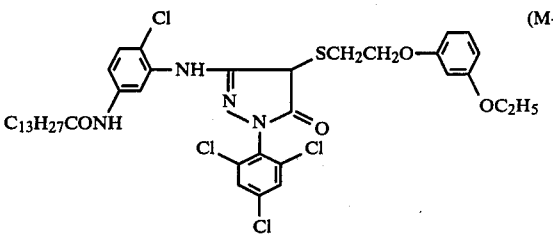
(M-10)
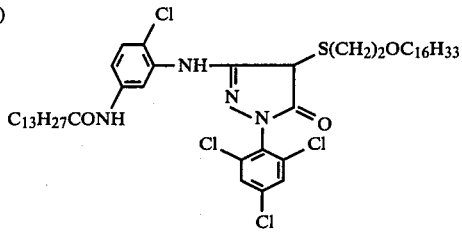

-continued
(M-11)
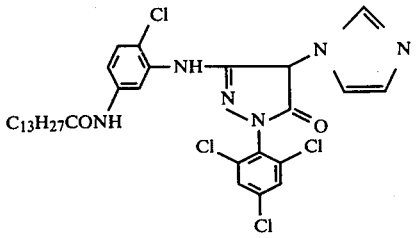
(M-12)
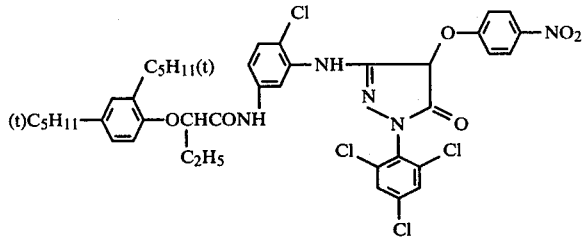
(M-13)
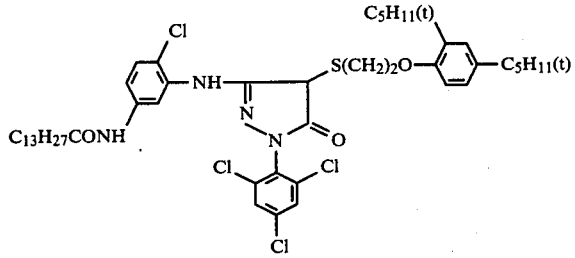
(M-14)
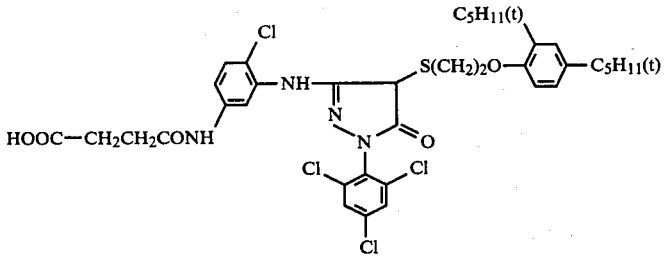
(M-15)
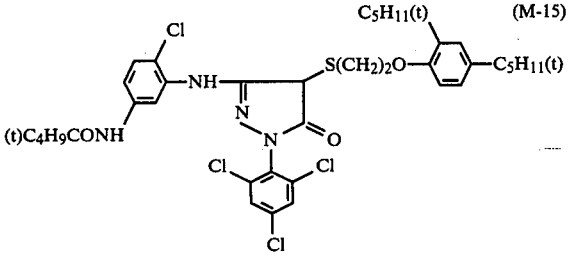
(M-16)
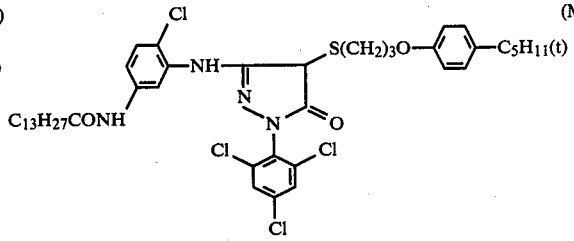
(M-17)
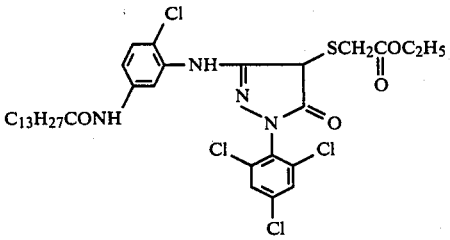
(M-18)
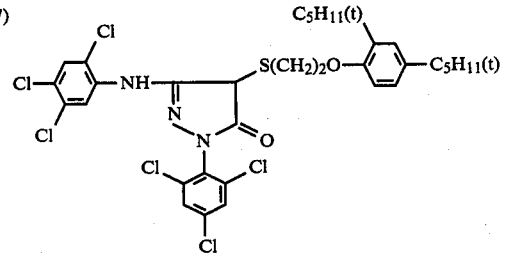
(M-19)
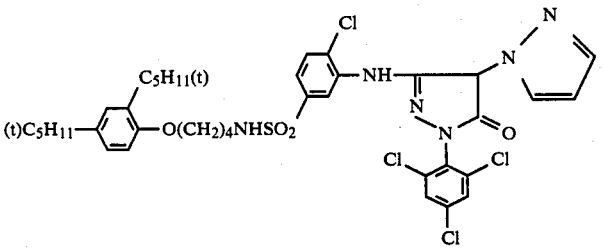

-continued
(M-20)
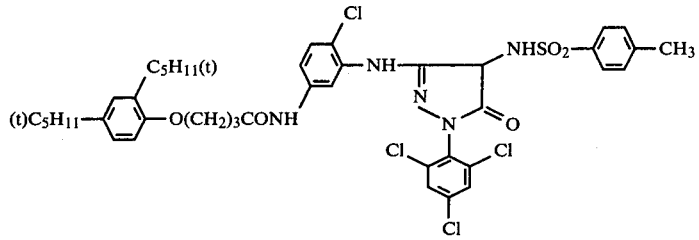
(M-21)
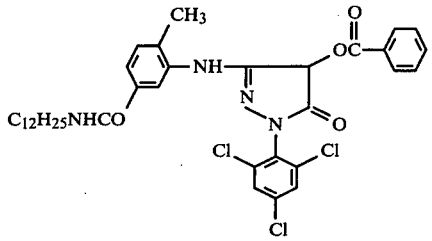
(M-22)
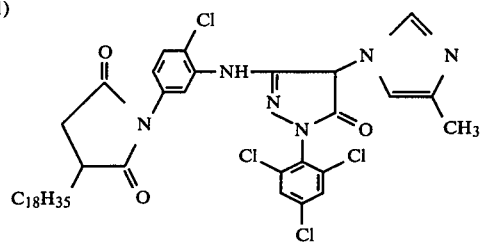
(M-23)
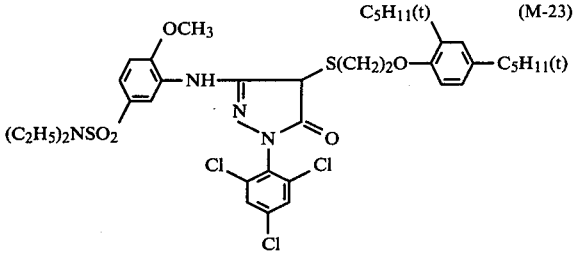
(M-24)
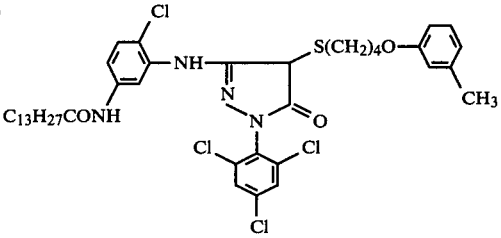
(M-25)
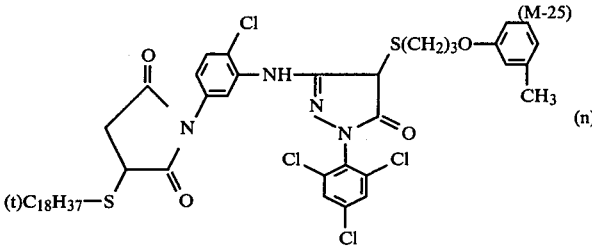
(M-26)
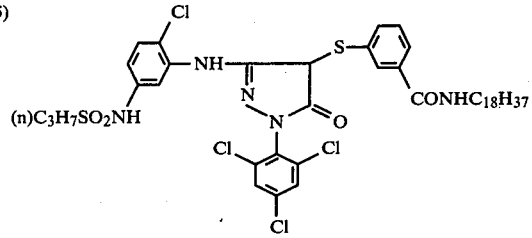
(M-27)
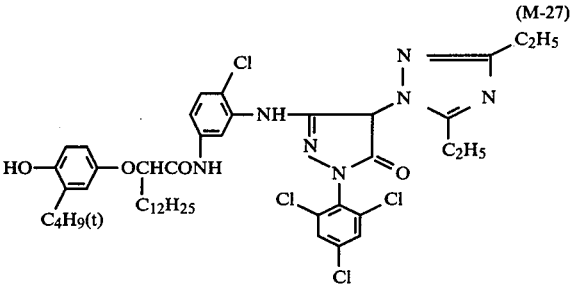
(M-28)
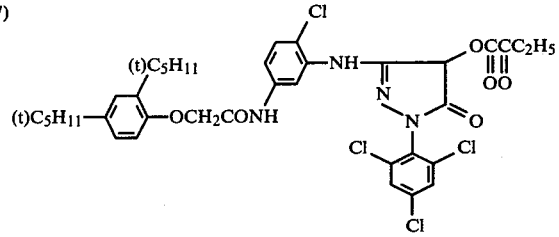
(M-29)
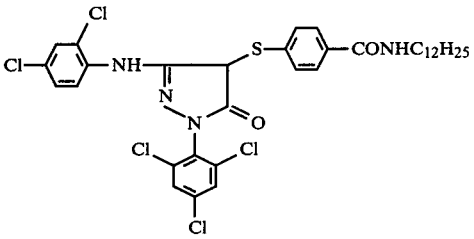
(M-30)
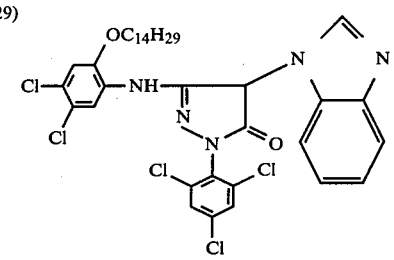

-continued
(M-31)
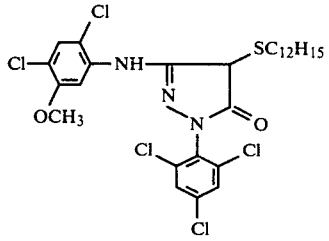
(M-32)
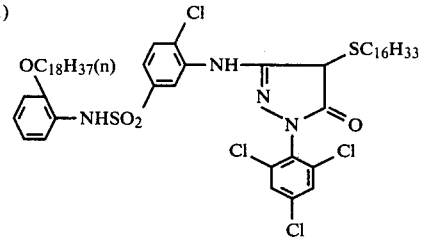
(M-33)
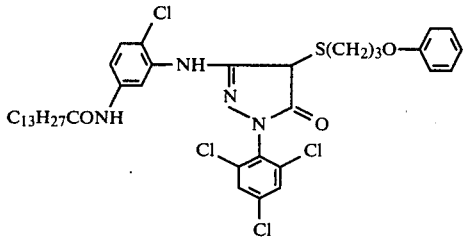
(M-34)
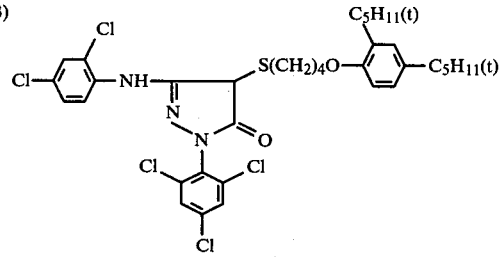
(M-35)
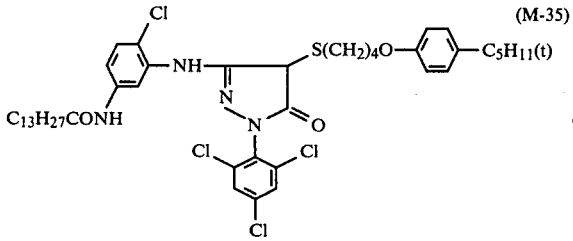
(M-36)
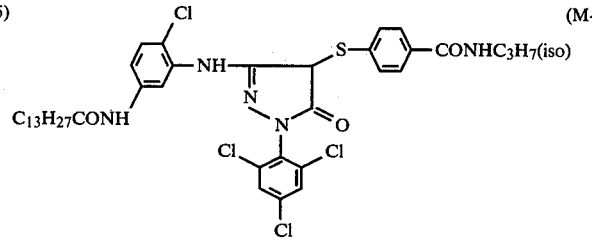
(M-37)
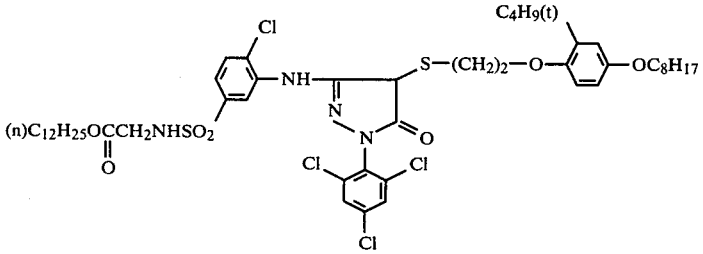
(M-38)
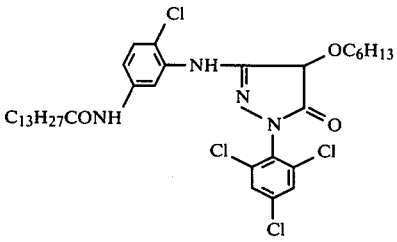
(M-39)
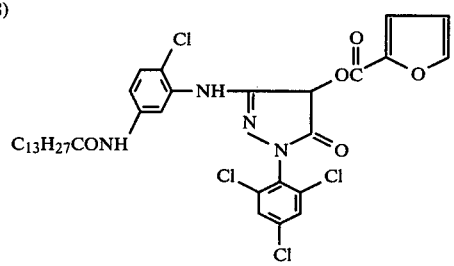
(M-40)
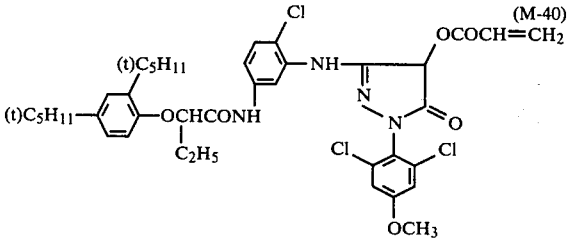
(M-41)
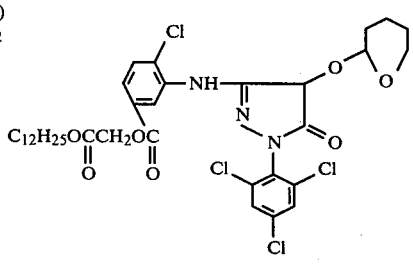

-continued
(M-42)
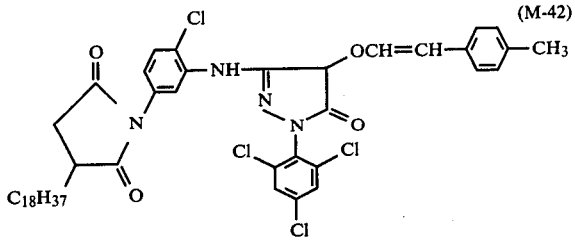
(M-43)
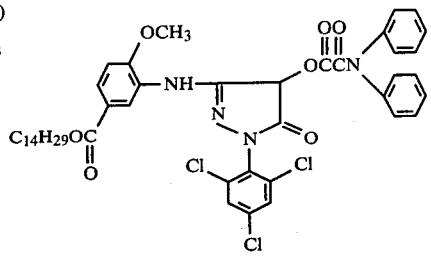
(M-44)
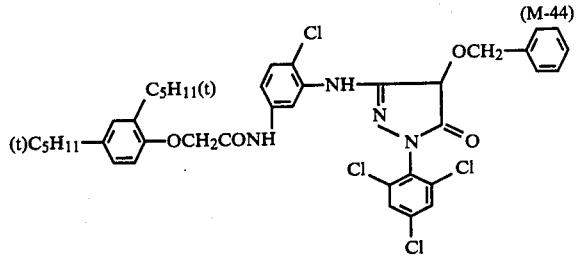
(M-45)
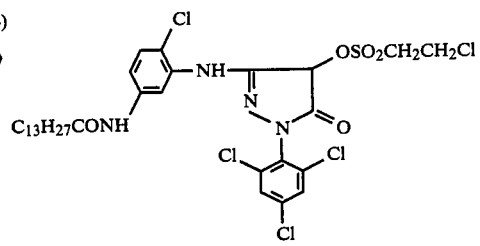
(M-46)
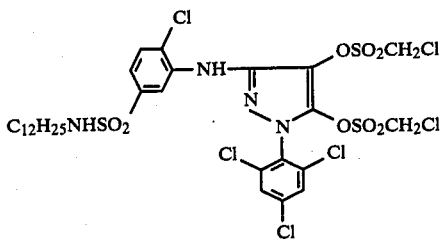
(M-47)
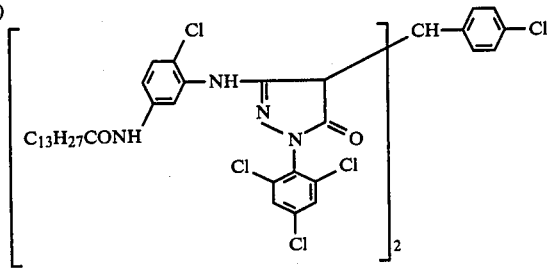
(M-48)
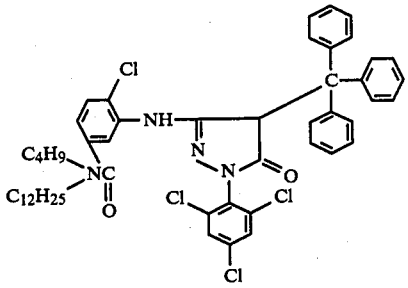
(M-49)
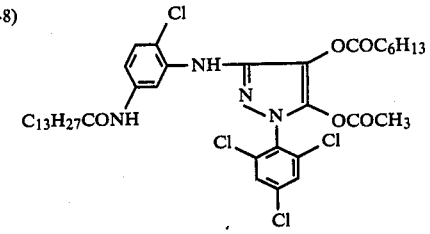
(M-50)
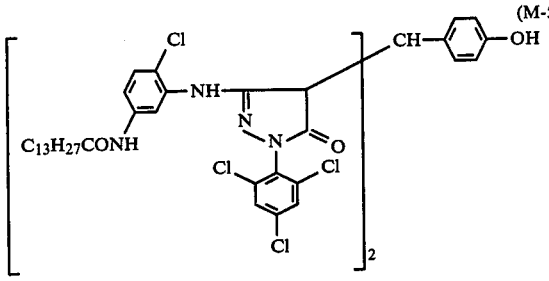
(M-51)
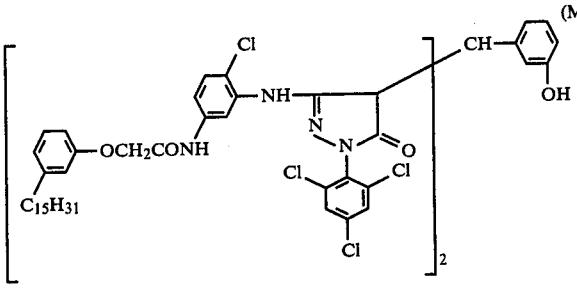
(M-52)
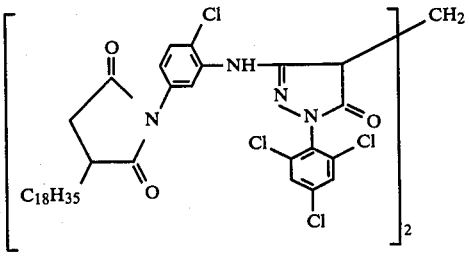
(M-53)
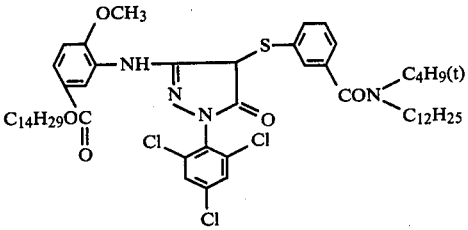

-continued
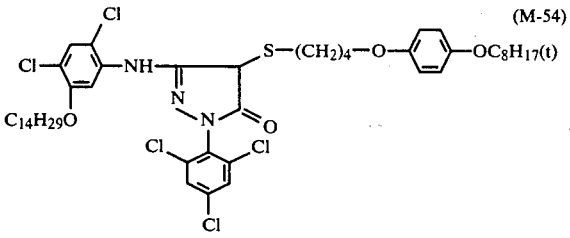
(M-54)
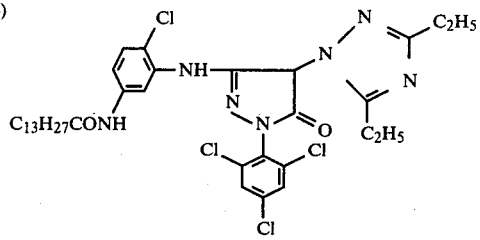
(M-55)
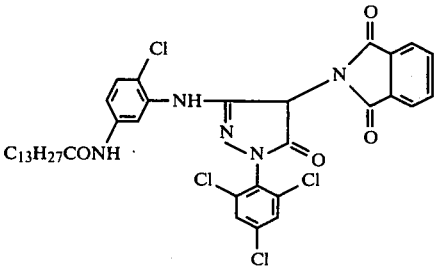
(M-56)
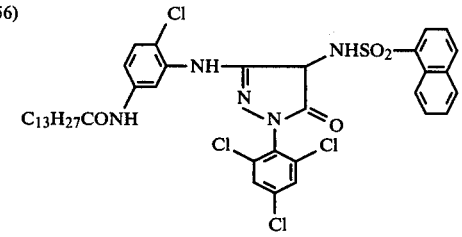
(M-57)
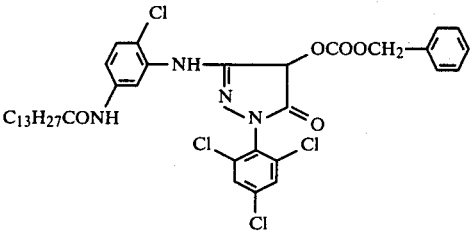
(M-58)
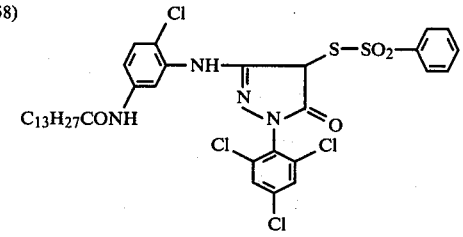
(M-59)
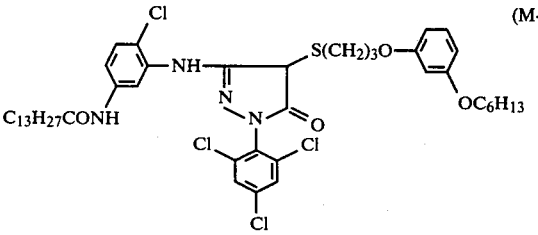
(M-60)
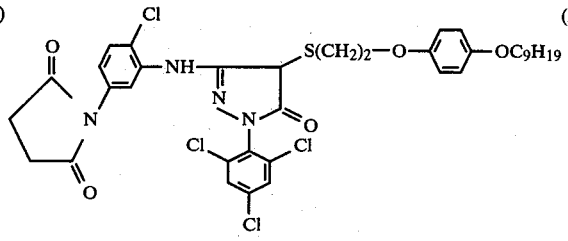
(M-61)
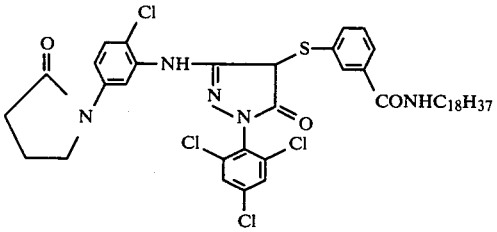
(M-62)
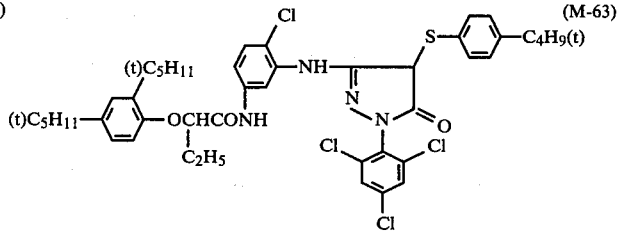
(M-63)
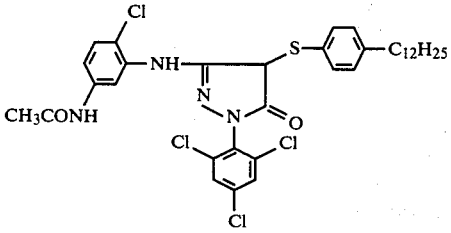
(M-64)
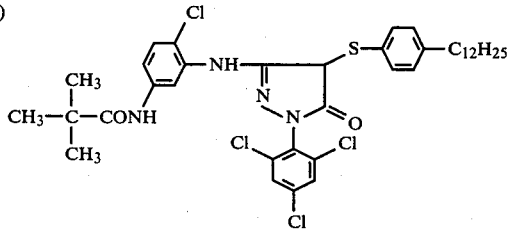
(M-65)

-continued (M-66)

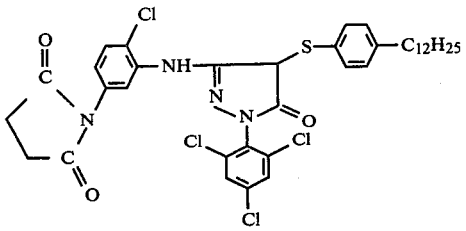

(M-67)

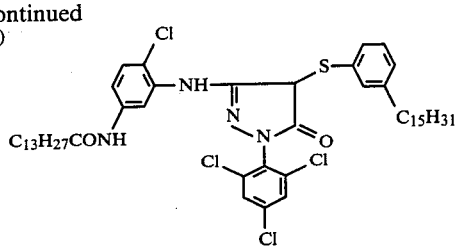

(M-68)

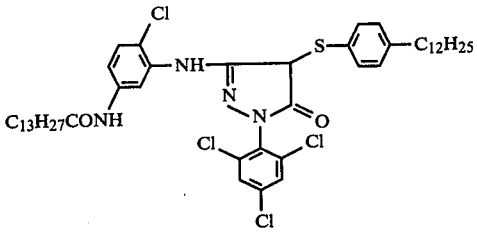

(M-69)

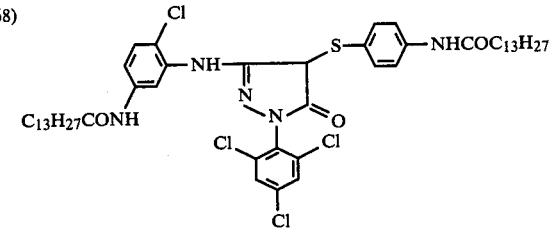

(M-70)

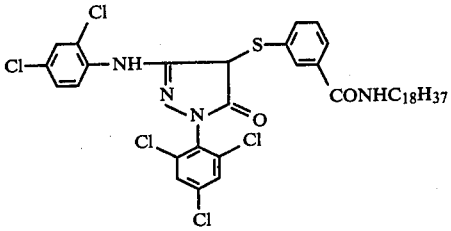

(M-71)

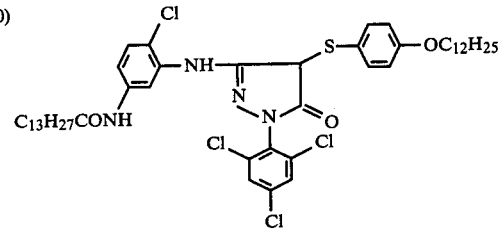

(M-72)

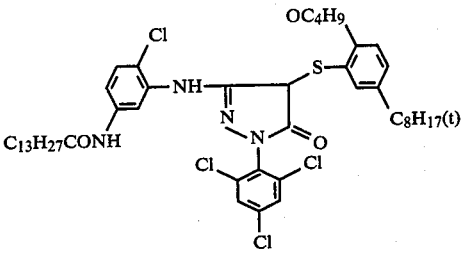

(M-73)

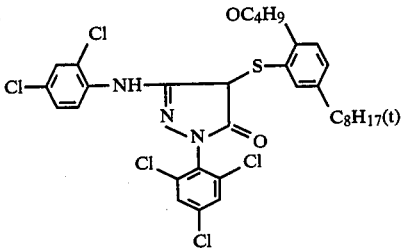

Particularly preferred magenta couplers are couplers (M-55), (M-67), (M-68), (M-71), (M-72) and (M-73).

When carrying out the present invention, the following known anti-fading agents can be used together. Furthermore, the dye image stabilizers used in connection with this invention can be used solely or as a combination of two or more stabilizers. Examples of the known anti-fading agents include hydroquinone derivatives described in, for example, U.S. Pat. Nos. 2,360,290, 2,418,613, 2,675,314, 2,701,197, 2,704,713, 2,728,659, 2,732,300, 2,735,765, 2,710,801 and 2,816,028, and British Patent No. 1,363,921; the gallic acid derivatives described in U.S. Pat. Nos. 3,457,079 and 3,069,262; the p-alkoxyphenols described in U.S. Pat. Nos. 2,735,765 and 3,698,909, and Japanese Patent Publication Nos. 20977/74 and 6623/77; and the p-oxyphenol derivatives described in U.S. Pat. Nos. 3,432,300, 3,573,050, 3,574,627 and 3,764,337, and Japanese Patent Application (OPI) Nos. 35633/77, 147434/77 and 152225/77; and the bisphenols described in U.S. Pat. No. 3,700,455.

The photographic silver halide emulsion layers or other hydrophilic colloid layers of the photographic materials of this invention may further contain stilbene series, triazine series, oxazole series or cumarin series whitening agents. The whitening agents may be water-soluble or water-insoluble, and may be used in the form of a dispersion. Practical examples of optical whitening agents used in this invention are described in U.S. Pat. Nos. 2,632,701, 3,269,840, and 3,359,102, and British Patent Nos. 852,075 and 1,319,763.

The hydrophilic colloid layers of the photographic materials of this invention may contain ultraviolet absorbents. Examples of ultraviolet absorbents used in this invention are aryl-substituted benzotriazole compounds described in, e.g., U.S. Pat. No. 3,533,794; 4-thiazolidone compounds described in, e.g., U.S. Pat. Nos. 3,314,794 and 3,352,681; benzophenone compounds described in, e.g., Japanese Patent Application (OPI) No. 2784/71; cinnamic acid esters described in, e.g., U.S. Pat. Nos. 3,705,805 and 3,707,375; butadiene compounds described in, e.g., U.S. Pat. No. 4,045,229; and benzoxazole compounds described in, e.g., U.S. Pat. No. 3,700,454. Moreover, the ultraviolet absorbents described in U.S. Pat. No. 3,499,762 and Japanese Patent Application (OPI) No. 48535/79 may be used in this invention. Furthermore, ultraviolet absorbing couplers (e.g., α-naphthol series cyan dye forming couplers) or ultraviolet absorbing polymers may be used in this invention. These ultraviolet absorbents may be mordanted in specific layers of the photographic materials of this invention.

The photographic materials of this invention may contain hydroquinone derivatives, aminophenol derivatives, gallic acid derivatives, ascorbic acid derivatives, etc., as color fogging preventing agents. Practical examples of them are described in U.S. Pat. Nos. 2,360,290, 2,336,327, 2,403,721, 2,418,613, 2,675,314, 2,701,197, 2,704,713, 2,728,659, 2,732,300 and 2,735,765 and Japanese Patent Application (OPI) Nos. 92988/75, 92989/75, 93928/75, 110337/75 and 146235/77 and Japanese Patent Publication No. 23813/75.

The blix solution used in this invention may contain various additives such as the blix accelerators described in U.S. Pat. Nos. 3,042,520, 3,241,966 and 3,578,454, and British Patent No. 1,150,466, and the thiol compounds described in Japanese Patent Application (OPI) No. 65732/78.

The color developer used in this invention may contain, in addition to the above-described color developing agent, a pH-buffer such as the sulfite, carbonate, borate or phosphate of an alkali metal and a development inhibitor and anti-foggant such as a bromide, iodide and an organic anti-foggant. Furthermore, the color developer may contain a water softener; a preservative such as hydroxylamine; an organic solvent such as benzyl alcohol, diethylene glycol, etc.; a development accelerator such as polyethylene glycol, a quaternary ammonium salt, amines, etc.; dye forming couplers; competing couplers; a fogging agent such as sodium borohydride; an auxiliary developing agent, such as 1-phenyl-3-pyrazolidone; a tackifier; the polycarboxylic acid series chelating agents described in U.S. Pat. No. 4,083,723; and the antioxidants described in West German Patent Application (OLS) No. 2,622,950.

The invention is explained in greater detail with reference to the following examples although it is not limited thereto.

EXAMPLE 1

A silver chlorobromide emulsion (50 mol% silver bromide) was coated on a polyethylene-laminated paper support to obtain the silver coverage shown in Table 1 (in this case the coating composition used was adjusted so that the gelatin coverage became 9 g/m$^2$) and a silver chlorobromide emulsion (50 mol% silver bromide) containing the cyan coupler described in Table 1 was coated thereon to obtain a gelatin coverage of 1.2 g/m$^2$ and a silver coverage of 0.3 g/m$^2$ (the coating compositions were adjusted so that the coverage of the cyan coupler became $8.5\times10^{-4}$ mol/m$^2$ on the whole samples). By further coating a gelatin protective layer (1 g/m$^2$) on the layer, Samples B to N were prepared. Sample A was prepared by forming 9 g/m$^2$ of a gelatin layer as the lower layer in place of the silver halide emulsion layer.

Each of these Samples A to N was exposed through an optical wedge and subjected to the following processings.

| Processing Step (30° C.) | Processing Time |
|---|---|
| Color Development | 3 min 30 sec |
| Blix | 1 min 30 sec |
| Wash | 3 min 30 sec |
| Drying | |

The compositions of the processing solutions used in the above processing steps were as follows:

| Color Developer | |
|---|---|
| Benzyl Alcohol | 10 ml |
| Diethylene Glycol | 3 ml |
| Potassium Carbonate | 25 g |
| Sodium Chloride | 0.1 g |
| Sodium Bromide | 0.2 g |
| Anhydrous Sodium Sulfite | 2 g |
| Hydroxylamine | 2 g |
| N—Ethyl-N—β-methanesulfonamidoethyl-3-methyl-4-aminoaniline Sulfate | 4 g |

Water was added to make 1 liter of the solution and the pH of the solution was adjusted to 10.0 using sodium hydroxide.

| Blix Solution A | |
|---|---|
| Ammonium Thiosulfate | 124.5 g |
| Sodium Metabisulfite | 13.3 g |
| Anhydrous Sodium Sulfite | 2.7 g |
| Ethylenediaminetetraacetic Acid Ferric Ammonium Salt | 65 g |

To the mixture of the above components were added 100 ml of the color developer having the above-described composition and water to make 1 liter of solution.

Blix Solution B

Prepared by adding 300 ml of the color developer having the above-described composition to the same composition as blix solution A.

| Blix Solution C | |
|---|---|
| Sodium Thiosulfate | 150 g |
| Sodium Sulfite | 15 g |
| Tetramminecobalt Complex Salt | 30 g |
| Ammonium Bromide | 50 g |

To the mixture of the above components were added 100 ml of the color developer having the aforesaid composition and water to make 1 liter of solution.

The maximum density was measured by means of Macbeth Densitometer Status AA Filter on each of these processed samples and the value ($D^R_{max}$) of the maximum density is shown in Table 1.

TABLE 1

| Sample No. | Silver Amount of First Coating Solution (g/m$^2$) | Cyan Coupler in Second Coating Solution | $D^R_{max}$ in Case of Using Blix Solution A | $D^R_{max}$ in Case of Using Blix Solution B | $D^R_{max}$ in Case of Using Blix Solution C |
|---|---|---|---|---|---|
| A | 0 | C-3 | 2.95 | 2.90 | 2.82 |
| B | 0.2 | " | 2.94 | 2.89 | 2.81 |
| C | 0.4 | " | 2.93 | 2.89 | 2.81 |
| D | 0.5 | " | 2.93 | 2.88 | 2.81 |
| E | 0.6 | " | 2.92 | 2.88 | 2.80 |
| F | 0.7 | " | 2.85 | 2.80 | 2.72 |
| G | 0.8 | " | 2.80 | 2.72 | 2.65 |

TABLE 1-continued

| Sample No. | Silver Amount of First Coating Solution ($g/m^2$) | Cyan Coupler in Second Coating Solution | $D^R_{max}$ in Case of Using Blix Solution A | $D^R_{max}$ in Case of Using Blix Solution B | $D^R_{max}$ in Case of Using Blix Solution C |
|---|---|---|---|---|---|
| H | 1.0 | " | 2.74 | 2.66 | 2.60 |
| I | 0.4 | C-9 | 3.05 | 3.01 | 2.95 |
| J | 0.6 | " | 3.03 | 2.98 | 2.93 |
| K | 1.0 | " | 2.91 | 2.85 | 2.79 |
| L | 0.4 | C-43 | 2.81 | 2.75 | 2.67 |
| M | 0.6 | " | 2.79 | 2.73 | 2.66 |
| N | 1.0 | " | 2.62 | 2.50 | 2.52 |

The results clearly show that the amount of silver in the layer formed below the cyan coupler-containing layer influences the density of the cyan coupler-containing layer. The results also clearly show that in the samples containing less than 0.6 $g/m^2$ of silver, the density reduction caused by the conversion of cyan dye into leuco compound has been improved.

EXAMPLE 2

Samples O to V of multilayer color photographic materials (Samples O and V are comparison samples) were prepared by coating the following layers on a paper support (both surfaces of which had been laminated with polyethylene) using couplers shown in Table 2 and at the coverages of silver shown in Table 2:

The 1st layer: Blue-sensitive layer
- Silver chlorobromide emulsion (Br 80 mol%)
- Yellow coupler (coverage $8.0\times10^{-4}$ $mol/m^2$)
- Coupler solvent: dioctylbutyl phosphate (coverage 300 $mg/m^2$)

The 2nd layer: Interlayer
- Gelatin (coverage 1,000 $mg/m^2$)

The 3rd layer: Green-sensitive layer
- Silver chlorobromide emulsion (Br 60 mol%)
- Magenta coupler (coverage $5.8\times10^{-4}$ $mol/m^2$)
- Coupler solvent: tricresyl phosphate (coverage 350 $mg/m^2$)

The 4th layer: Interlayer
- Gelatin (coverage 1,200 $mg/m^2$)
- Ultraviolet absorbent solvent: dibutyl phthalate (coverage 250 $mg/m^2$)
- Ultraviolet abosrbent: 2-(2-hydroxy-3-sec-butyl-5-tert-butylphenyl)benzotriazole (coverage 1,000 $mg/m^2$)

The 5th layer: Red-sensitive layer
- Silver chlorobromide emulsion (Br 50 mol%)
- Cyan coupler (coverage $8.5\times10^{-4}$ $mol/m^2$)
- Coupler solvent: dibutyl phthalate (coverage 200 $mg/m^2$)

The 6th layer: Protective layer
- Gelatin (coverage 1,000 $mg/m^2$)

TABLE 2

| Sample | The 5th Layer: Silver Coverage ($g/m^2$) | The 5th Layer: Cyan Coupler | The 3rd Layer: Silver Coverage ($g/m^2$) | The 3rd Layer: Magenta Coupler | The 1st Layer: Silver Coverage ($g/m^2$) | The 1st Layer: Yellow Coupler |
|---|---|---|---|---|---|---|
| O | 0.3 | C-3 | 0.4 | M* | 0.4 | Y-8 |
| P | " | " | 0.2 | " | 0.2 | " |
| Q | " | " | " | M-1 | 0.4 | " |
| R | " | " | 0.18 | M-2 | " | Y-79 |
| S | " | " | " | " | 0.35 | " |
| T | " | " | 0.15 | M-27 | " | " |
| U | " | " | 0.2 | M-74 | " | " |
| V | " | " | 0.4 | " | 0.4 | " |

M*: 1-(2,4,6-trichlorophenyl)-3-(2-chloro-5-tetradecanamido)-anilino-2-pyrazolin-5-one Each sample was exposed and processed as in Example 1. However, blix solution D was also employed.

Blix Solution D

A fatigued solution formed by using blix solution A for continuous processing in an automatic processor for color photographic papers.

The maximum densities of yellow images, magenta images, and cyan images of the samples after processing are shown in Table 3.

TABLE 3

| Sample | Blix Solution A | | | Blix Solution B | | | Blix Solution C | | | Blix Solution D | | |
|---|---|---|---|---|---|---|---|---|---|---|---|---|
| | $D^B_{max}$ | $D^G_{max}$ | $D^R_{max}$ | $D^B_{max}$ | $D^G_{max}$ | $D^R_{max}$ | $D^B_{max}$ | $D^G_{max}$ | $D^R_{max}$ | $D^B_{max}$ | $D^G_{max}$ | $D^R_{max}$ |
| O* | 2.10 | 2.48 | 2.80 | 2.10 | 2.48 | 2.75 | 2.11 | 2.49 | 2.82 | 2.10 | 2.48 | 2.72 |
| P | 1.74 | 1.90 | 2.92 | 1.75 | 1.90 | 2.93 | 1.75 | 1.88 | 2.93 | 1.74 | 1.89 | 2.89 |
| Q | 2.11 | 2.54 | 2.91 | 2.10 | 2.55 | 2.91 | 2.11 | 2.54 | 2.92 | 2.09 | 2.53 | 2.89 |
| R | 2.13 | 2.50 | 2.93 | 2.13 | 2.51 | 2.94 | 2.14 | 2.51 | 2.94 | 2.12 | 2.50 | 2.91 |
| S | 2.03 | 2.50 | 2.93 | 2.02 | 2.51 | 2.93 | 2.02 | 2.50 | 2.95 | 2.03 | 2.50 | 2.92 |
| T | 2.03 | 2.46 | 2.95 | 2.03 | 2.46 | 2.95 | 2.02 | 2.45 | 2.96 | 2.02 | 2.45 | 2.92 |
| U | 2.02 | 2.55 | 2.91 | 2.02 | 2.55 | 2.91 | 2.03 | 2.54 | 2.92 | 2.02 | 2.55 | 2.90 |
| V* | 2.03 | 2.78 | 2.80 | 2.01 | 2.76 | 2.76 | 2.02 | 2.78 | 2.83 | 2.01 | 2.77 | 2.71 |

*Samples O and V are comparison samples and other samples P to U are samples of this invention.

The results clearly show that a reduction in color density by the conversion of cyan dye into leuco compound is closely related to the composition of the processing solution and the processing step. Furthermore, the results show that even when using a fatigued bleach solution D (which gives the most serious reduction in coloring density by the conversion into leuco compound), Samples P to U of this invention show less change in coloring density.

As is clear from Example 1 and Example 2, the reduction in coloring density caused by the conversion of a cyan dye into a leuco compound can be very effectively prevented when the total amount of silver existing in the silver halide emulsion layers disposed under the silver halide emulsion layer containing a cyan coupler is decreased below 0.6 $g/m^2$. This discovery can be applied to color photographic materials. However, in order to apply this invention, the blue-sensitive emulsion layer and the green-sensitive emulsion layer should be disposed so that the total silver amount therein is less than 0.6 g/m$^2$ and they give desired yellow density and magenta density respectively. As shown in Example 2, the green-sensitive emulsion layer has a maximum density which deviates largely dependent upon the deviation of the silver coverage of the layer. Accordingly, it has been necessary to develop magenta couplers which do not show a reduced maximum density when the silver coverage of the magenta coupler-containing emulsion layer is decreased.

As the result of various investigations, it has further been discovered that a series of magenta couplers previously described in this specification meet the aforesaid purpose. That is, by using these magenta couplers it is possible to prevent a reduction in coloring density in the magenta coupler-containing silver halide emulsion layer when the silver content in the emulsion layer is decreased in order to prevent a reduction in coloring density of the cyan coupler-containing emulsion layer by the conversion of cyan dyes into leuco compounds. In other words, the invention may be applied to all types of magenta couplers. However, in order to obtain a desired magenta density in the magenta coupler-containing emulsion layer, it is preferred (and in some situations necessary) to use the magenta couplers described above.

While the invention has been described in detail and with reference to specific embodiments thereof, it will be apparent to one skilled in the art that various changes and modifications can be made therein without departing from the spirit and scope thereof.

What is claimed is:

1. A process of blixing an exposed color-developed silver halide color photographic material comprising a support having coated thereon a cyan coloring silver halide emulsion layer as the outermost coloring silver halide emulsion layer, a magenta coloring silver halide emulsion layer, and a yellow coloring silver halide emulsion layer; said process carried out by means of a blix bath contaminated with a developing agent comprising the steps of: preparing said layers such that there are 0.6 g/m$^2$ or less of silver in the silver halide emulsion layers disposed closer to the support from the cyan coloring silver halide emulsion layer; and blixing said silver halide color photographic layers, said process comprising exposing, color developing and blixing without image intensifying processing.

2. The process as claimed in claim 1, wherein the silver halide color photographic material is a color photographic paper comprising a support, a yellow coloring silver halide emulsion layer formed on said support, a magenta coloring silver halide emulsion layer formed on said yellow layer, and a cyan coloring silver halide emulsion layer formed on said magenta layer wherein the total amount of silver in the magenta coloring emulsion layer and the yellow coloring emulsion layer is below 0.6 g/m$^2$.

3. The process as claimed in claim 1, wherein the cyan coloring silver halide emulsion layer contains a cyan coupler represented by the formula (I):

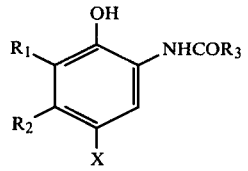

(I)

wherein $R_1$ and $R_2$ are each independently hydrogen, a halogen atom, an alkyl group, a substituted alkyl group, an aryl group, a substituted aryl group, an amino group, a carbamoyl group or an acylamino group; $R_3$ represents an alkyl group, a substituted alkyl group, an aryl group or a substituted aryl group; and X represents hydrogen or a coupling-off group;

the magenta coloring silver halide emulsion layer contains a magenta coupler represented by the formula (III):

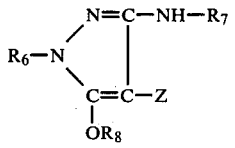

(III)

wherein $R_6$ and $R_7$ are each independently a phenyl group or a substituted phenyl group; $R_8$ represents an acyl group or hydrogen; and Z represents hydrogen or a coupling-off group; and the yellow coloring silver halide emulsion layer contains a yellow coupler represented by the formula (II):

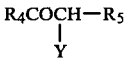

(II)

wherein $R_4$ represents an alkyl group, a substituted alkyl group, an aryl group or a substituted aryl group; $R_5$ represents a cyano group, an N-phenylcarbamoyl group or a substituted N-phenylcarbamoyl group; and Y represents a coupling-off group.

* * * * *